US007837140B2

(12) United States Patent
Zitella et al.

(10) Patent No.: US 7,837,140 B2
(45) Date of Patent: Nov. 23, 2010

(54) AUTOMATIC FILM CHANGER FOR A FILM WRAPPING MACHINE

(75) Inventors: Marco Zitella, Montreal (CA); Faruk Turfan, Brossard (CA)

(73) Assignee: Illinois Tool Works Inc., Glenview, IL (US)

( * ) Notice: Subject to any disclaimer, the term of this patent is extended or adjusted under 35 U.S.C. 154(b) by 531 days.

(21) Appl. No.: 11/723,220

(22) Filed: Mar. 19, 2007

(65) Prior Publication Data

US 2008/0229707 A1 Sep. 25, 2008

(51) Int. Cl.
*B65H 19/00* (2006.01)

(52) U.S. Cl. ..... 242/559.4; 242/559.3; 53/168; 53/556; 53/588

(58) Field of Classification Search ..... 242/558, 242/559, 559.3, 559.4, 559.1, 564.3, 564.4, 242/564.5, 588, 160.1, 338, 338.4, 348, 348.3, 242/354; 414/736, 911; 53/168, 389.2, 556, 53/587, 588

See application file for complete search history.

(56) References Cited

U.S. PATENT DOCUMENTS

| | | | | |
|---|---|---|---|---|
| 1,807,274 | A * | 5/1931 | Beidler | 242/419.2 |
| 4,587,796 | A | 5/1986 | Haloila | |
| 4,930,976 | A * | 6/1990 | Spacher et al. | 414/744.8 |
| 5,517,807 | A | 5/1996 | Morantz | |
| 5,787,691 | A | 8/1998 | Turfan | |
| 5,855,106 | A * | 1/1999 | Koyama et al. | 53/556 |
| 6,195,961 | B1 | 3/2001 | Turfan | |
| 6,494,400 | B1 * | 12/2002 | Zitella et al. | 242/559.3 |
| 6,772,573 | B2 | 8/2004 | Federeszyn | |
| 7,356,976 | B2 * | 4/2008 | Tosa | 53/399 |
| 2010/0025517 | A1 * | 2/2010 | Cere | 242/559.1 |

FOREIGN PATENT DOCUMENTS

| | | |
|---|---|---|
| EP | 1097867 A1 * | 5/2001 |
| EP | 1502856 | 5/2002 |
| EP | 1201584 | 2/2005 |
| JP | 5978056 | 5/1984 |

* cited by examiner

*Primary Examiner*—Michael R Mansen
*Assistant Examiner*—Juan J Campos
(74) *Attorney, Agent, or Firm*—Law Offices of Steven W. Weinrieb

(57) ABSTRACT

A new and improved film wrapping machine includes a new and improved film changer, operatively associated with the film wrapping machine, for automatically exchanging rolls of wrapping film, wherein a depleted roll of wrapping film, or a roll of wrapping film that has experienced a breakage in the wrapping film, can be automatically removed from the film roll mounting and dispensing carriage assembly, and wherein further, a fresh roll of wrapping film can be positionally exchanged for the depleted roll of wrapping film, or for the roll of wrapping film that has experienced the breakage.

20 Claims, 14 Drawing Sheets

AUTOMATIC FILM CHANGER FOR A FILM WRAPPING MACHINE

FIELD OF THE INVENTION

The present invention relates generally to film wrapping machines for wrapping film around palletized loads, and more particularly to a new and improved film wrapping machine which includes a new and improved film changer, operatively associated with the film wrapping machine, for automatically exchanging rolls of wrapping film, wherein a depleted roll of wrapping film, or a roll of wrapping film that has experienced a breakage in the wrapping film, can be automatically removed from the film roll mounting and dispensing carriage assembly, disposed upon the ring member of the film wrapping machine which rotates around the palletized load being wrapped within the film wrapping material, and wherein a fresh roll of wrapping film can be positionally exchanged for the depleted roll of wrapping film, or for the roll of wrapping film that has experienced the breakage, as a result of the fresh roll of wrapping film being subsequently mounted upon the film roll mounting and dispensing carriage assembly, disposed upon the rotary ring member of the film wrapping machine, so as to effectively complete the replacement of the depleted roll of wrapping film or the roll of wrapping film which experienced a breakage in the wrapping film.

BACKGROUND OF THE INVENTION

Film wrapping or packaging machines or apparatus, for wrapping articles, packages, or palletized loads within wrapping film, are of course well known in the art. Examples of such film wrapping machines or apparatus are disclosed within U.S. Pat. No. 6,195,961 which issued to Turfan on Mar. 6, 2001, U.S. Pat. No. 5,787,691 which issued to Turfan on Aug. 4, 1998, U.S. Pat. No. 5,517,807 which issued to Morantz on May 21, 1996, and U.S. Pat. No. 4,587,796 which issued to Haloila on May 13, 1986. As disclosed within FIG. 1, which substantially corresponds to FIG. 1 of the aforenoted U.S. Pat. No. 6,195,961 of Turfan, and which is representative of the conventional film wrapping or packaging machines, a film wrapping or packaging machine is generally indicated by the reference character 10 and is seen to comprise a four-post upstanding framework 12 through which extends a conveyor 14 for conveying articles, packages, or palletized loads, to be wrapped or packaged, to a wrapping station 16 which is located substantially at the center of the region or area which is peripherally defined by means of the four upstanding posts of the framework 12. An upper frame member 18, which is vertically movable in a reciprocating manner with respect to the framework 12, rotatably supports a ring or circular track member 20 upon which is mounted a plastic film roll mounting and dispensing assembly or carriage 22 upon which, in turn, is mounted a roll 24 of plastic wrapping film. Consequently, when the upper frame member 18 is moved in vertically upward and downward directions, and the ring or track member 20 is rotated with respect to the vertically movable upper frame member 18, film from the film roll 24, mounted upon the film roll mounting and dispensing assembly or carriage 22, can be withdrawn therefrom and applied onto the articles, packages, or palletized loads which are to be wrapped within film packaging material and which are disposed or located at the wrapping station 16.

It can of course be appreciated that after a plurality of articles, packages, or palletized loads have been wrapped within the film packaging or wrapping material disposed upon and withdrawn from the film roll 24, the film roll 24 will eventually become depleted and must therefore be replaced by means of a fresh roll of wrapping or packaging film. Alternatively, during a film wrapping operation, the packaging or wrapping film may in fact experience breakage. In either instance, therefore, the film roll 24, disposed upon the film roll mounting and dispensing assembly or carriage 22, must be replaced with a fresh and intact roll of wrapping or packaging film. While such an exchange or replacement procedure may of course be performed manually, such a procedure is tedious and time-consuming. More particularly, the wrapping operation must be temporarily halted or terminated, the upper frame member 18, upon which the ring or track member 20 and the film roll mounting and dispensing assembly or carriage 22 are mounted, must be vertically moved to an elevation at which the operator personnel can access the film roll 24 disposed upon the film roll mounting and dispensing assembly or carriage 22, the depleted roll of packaging or wrapping film, or the roll of packaging or wrapping film which experienced the break in the film, must then be removed from the film roll mounting and dispensing assembly or carriage 22, and a new or fresh roll of wrapping or packaging film 24 must be mounted upon the film roll mounting and dispensing assembly or carriage 22.

A need therefore exists in the art for a new and improved film changer, operatively associated with a film wrapping machine, which can automatically exchange rolls of wrapping film, wherein a depleted roll of wrapping film, or a roll of wrapping film which has experienced a breakage in its wrapping film, can be automatically removed from the film roll carriage and wherein a fresh roll of wrapping film can effectively be positionally exchanged with the depleted roll of wrapping film, or with the roll of wrapping film that has experienced the breakage as a result of the fresh roll of wrapping film being subsequently mounted upon the film roll carriage so as to effectively complete the replacement of the depleted roll of wrapping film or the roll of wrapping film which experienced a breakage in the wrapping film.

SUMMARY OF THE INVENTION

The foregoing and other objectives are achieved in accordance with the teachings and principles of the present invention through the provision of a new and improved automatic film changer, operatively associated with a film wrapping machine, for automatically changing rolls of wrapping film, wherein the automatic film changer comprises a transfer carriage assembly upon which at least two sets of arms are mounted upon opposite sides of an upstanding post or mast for respectively supporting separable carriage assemblies upon which a new or fresh roll of film, and the depleted film core, or the roll of film which experienced a breakage, are respectively supported. The upstanding post or mast is mounted upon a longitudinally movable support plate which is capable of being moved toward and away from the fixed film roll mounting and dispensing carriage assembly mounted upon the rotary ring member of the film wrapping machine, and the upstanding post or mast is also rotatably mounted upon the longitudinally movable support plate so as to be rotatable about its vertically oriented axis.

Accordingly, when a depleted roll of wrapping film, or a roll of wrapping film which has experienced a breakage in its wrapping film, is to be replaced, the transfer carriage assembly is moved toward the fixed film roll mounting and dispensing carriage assembly, mounted upon the rotary ring member of the film wrapping machine, with the new or fresh roll of film, mounted upon the first separable carriage assembly, disposed upon the side of the transfer carriage assembly which is disposed or facing away from the fixed film roll mounting and dispensing carriage assembly mounted upon the rotary ring member of the film wrapping machine. Suitable mechanisms, disposed upon the transfer carriage assembly, then grasp, support, and remove the second separable carriage assembly, containing the depleted roll of film, or the roll of film which experienced a breakage, from the fixed film roll mounting and dispensing carriage assembly mounted upon the rotary ring member of the film wrapping machine. The upstanding post or mast is then effectively retracted away from the fixed film roll mounting and dispensing carriage assembly and rotated through means of a predetermined angular rotation, such as, for example, 180°, so that the first separable carriage assembly, containing the new or fresh roll of film, is now disposed toward or facing the fixed film roll mounting and dispensing carriage assembly mounted upon the rotary ring member of the film wrapping machine. The transfer carriage assembly is then moved toward the fixed film roll mounting and dispensing carriage assembly whereby the mechanisms of the transfer carriage assembly mount the first separable carriage assembly, containing the new or fresh roll of film, upon the fixed film roll mounting and dispensing carriage assembly mounted upon the rotary ring member of the film wrapping machine. The film roll exchange or replacement operation or procedure is therefore completed, the transfer carriage assembly is then retracted away from the fixed film roll mounting and dispensing carriage assembly mounted upon the rotary ring member of the film wrapping machine, and the article, package, or palletized load wrapping operation can then be resumed.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 2:
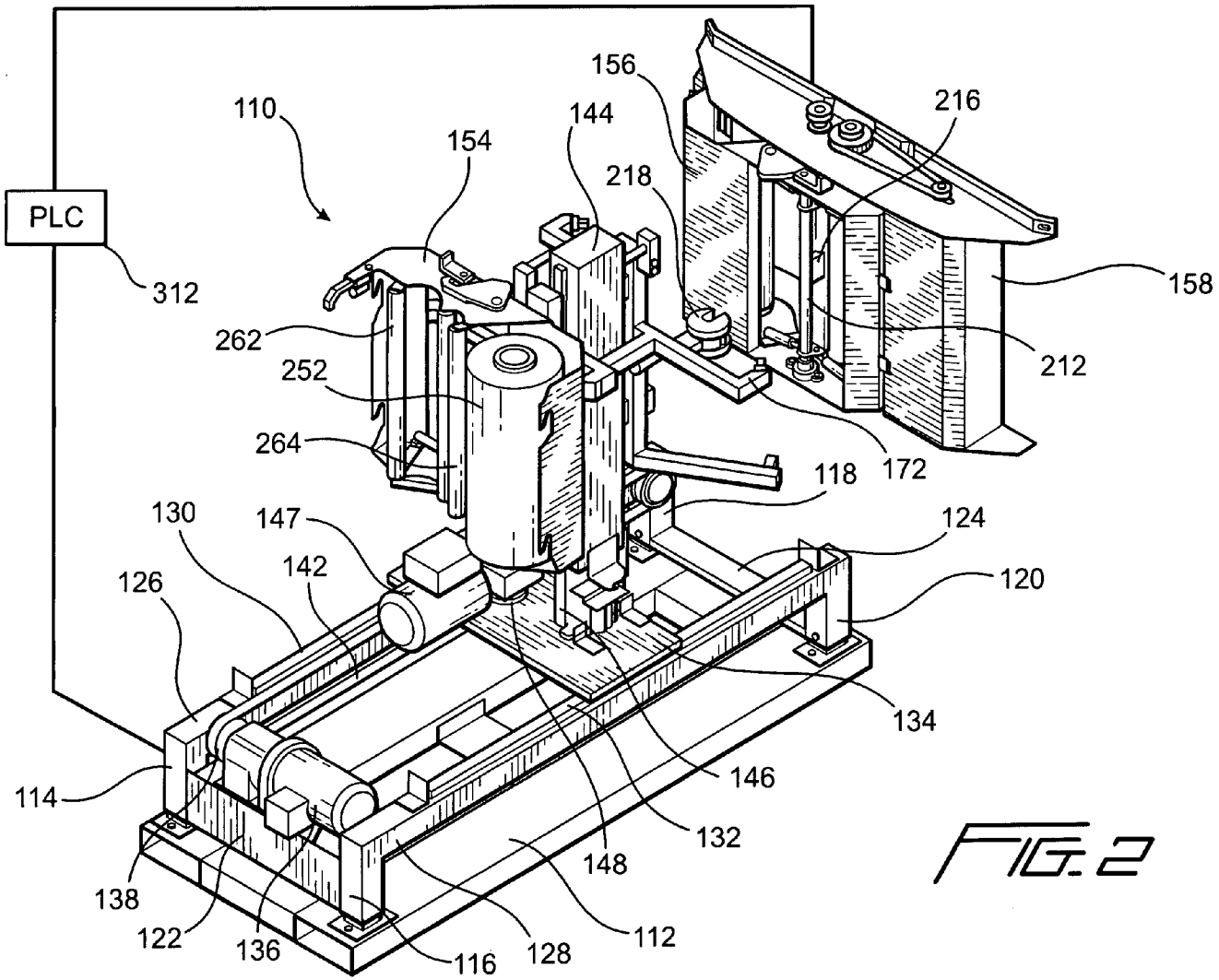
FIG. 2 is a left side perspective view of a new and improved automatic film changer assembly, constructed in accordance with the principles and teachings of the present invention, for use in conjunction with a film wrapping machine, wherein the new and improved automatic film changer assembly has a new or fresh roll of wrapping or packaging film disposed upon a first separable carriage assembly that is disposed upon a first side of the upstanding post or mast member of the automatic film changer assembly, and wherein the upstanding post or mast member is seen approaching the fixed film roll mounting and dispensing carriage assembly that is mounted upon the rotary ring member of the film wrapping machine so as to remove a second separable carriage assembly, having mounted thereon a core member of a depleted roll of wrapping or packaging film, or a roll of wrapping or packaging film which has experienced a breakage in its wrapping or packaging film, from the fixed film roll mounting and dispensing carriage assembly that is mounted upon the rotary ring member of the film wrapping machine.
Figure 6:
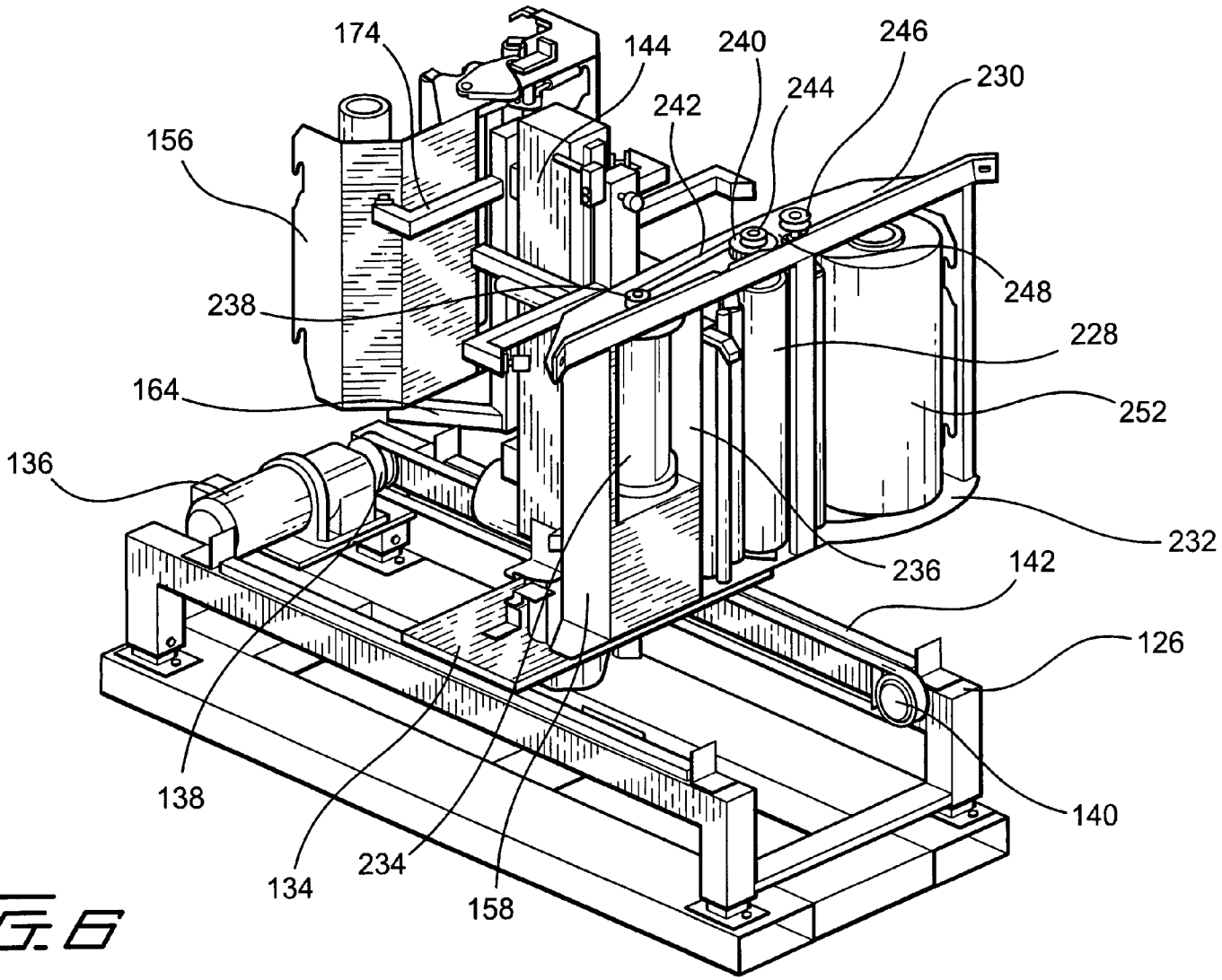
FIG. 6 is a right side perspective view corresponding to that of FIG. 5 wherein the first separable carriage assembly, having the new or fresh roll of wrapping or packaging film mounted thereon, has been mounted upon the fixed film roll mounting and dispensing carriage assembly that is mounted upon the rotary ring member of the film wrapping machine, and wherein further, the automatic film changer has been longitudinally moved or retracted away from the fixed film roll mounting and dispensing carriage assembly that is mounted up-on the rotary ring member of the film wrapping machine.
Figure 7:
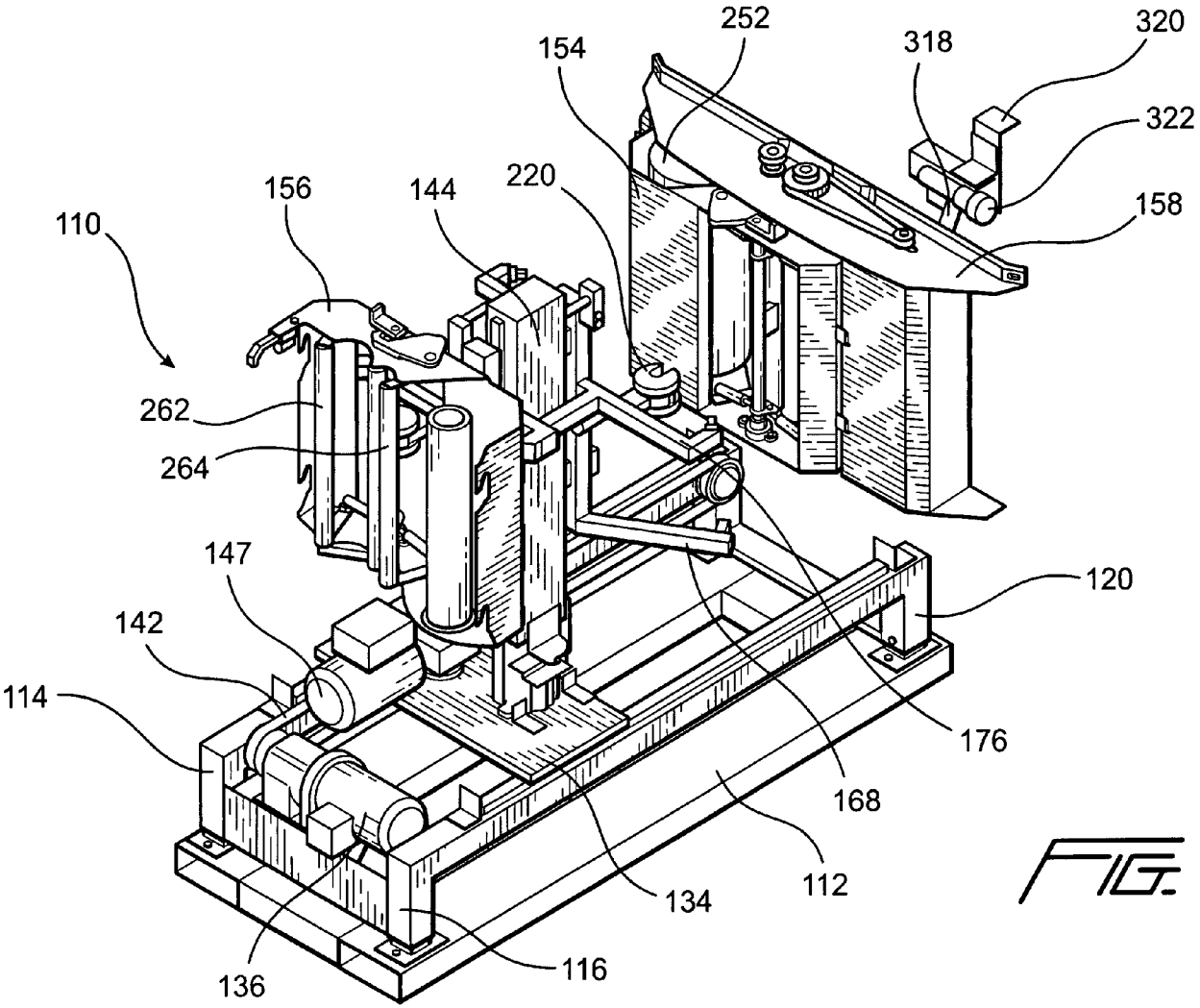
FIG. 7 is a perspective view, similar to that of FIG. 5, wherein the upstanding post or mast member has been moved or retracted further away from the fixed film roll mounting and dispensing carriage assembly that is mounted upon the rotary ring member of the film wrapping machine, and wherein further, an automatic film changer clamping mechanism, which is disposed upon the rotary ring member of the film wrapping machine, is disclosed for grasping the film tail of the new or fresh roll of wrapping or packaging film, from a film tail holder mechanism which is part of the first separable carriage assembly, in preparation for commencing or resuming a film wrapping or packaging cycle.

Referring now to the drawings, and more particularly to FIG. 2 thereof, a new and improved automatic film changer assembly, constructed in accordance with the principles and teachings of the present invention, is disclosed and is generally indicated by the reference character 110. More particularly, it is seen that the new and improved automatic film changer assembly 110 comprises a base platform 112 which is adapted to be disposed near or adjacent to the film wrapping machine and which has a substantially rectangular parallelepiped configuration and which has four upstanding framework posts 114,116,118,120 fixedly mounted thereon within the four corner regions thereof. A pair of longitudinally spaced, transversely oriented framework cross-bars or beams 122,124 respectively interconnect lower end portions of the upstanding framework posts 114,116 and 118,120, while a pair of transversely spaced, longitudinally oriented framework members 126,128 respectively interconnect upper end portions of the upstanding framework posts 114,118 and 116, 120. A pair of longitudinally extending linear bearings 130, 132 are respectively mounted atop the pair of transversely spaced, longitudinally oriented framework members 126,128, and a support plate 134 has its oppositely disposed side edge portions operatively connected to the linear bearings 130,132 so as to be movable in opposite longitudinally oriented directions along the linear bearings 130,132. A first reversible drive motor 136 is fixedly mounted upon the transversely oriented framework cross-bar 122, and the output drive shaft of the first reversible drive motor 136 is provided with a drive pulley 138 which can best be seen in FIG. 6. A driven pulley 140 is rotatably mounted upon an inner vertical wall portion of the longitudinally oriented frame-work member 126 which is located at the end of the longitudinally oriented framework member 126 that is most remote from the drive motor 136 and its drive pulley 138, as can also be best seen in FIG. 6, and an endless drive belt 142 is disposed around the drive pulley 138 and the driven pulley 140. An undersurface portion of the support plate 134 is fixedly attached to an upper run portion of the drive belt 142, and accordingly, when the first reversible drive motor 136 is operated in either one of its two opposite directional modes so as to accordingly move the drive belt 142 in either one of its two opposite directions, the support plate 134 will be moved in opposite directions along the linear bearings 130,132.

Continuing further, it is also seen that an upstanding post or mast 144 projects vertically upwardly from the support plate 134 and is adapted to be rotatably mounted upon the support plate 134 through means of, for example, a suitable bearing assembly 146 which is fixedly mounted upon the upper surface portion of the support plate 134. The lower end portion of the upstanding post or mast 144 passes through the support plate 134 and is provided with a driven pulley, not shown, and a second reversible drive motor 147 is also fixedly mounted upon the upper surface portion of the support plate 134 through means of its output drive shaft housing 148. The lower end portion of the output drive shaft of the second reversible drive motor 147 also passes through the support plate 134 and is provided with a drive pulley, not shown, and a second drive belt, also not shown, operatively interconnects the drive pulley of the output drive shaft of the second reversible drive motor 147 with the driven pulley disposed upon the lower end portion of the upstanding post or mast 144. In this manner, when the second reversible drive motor 147 is operated in either one of its two directional modes, the upstanding post or mast 144 will be angularly rotated in either one of two opposite directions through means of the aforenoted second reversible drive motor drive pulley, the upstanding post or mast driven pulley, and the drive belt, all disposed beneath the support plate 134.

Figure 3:
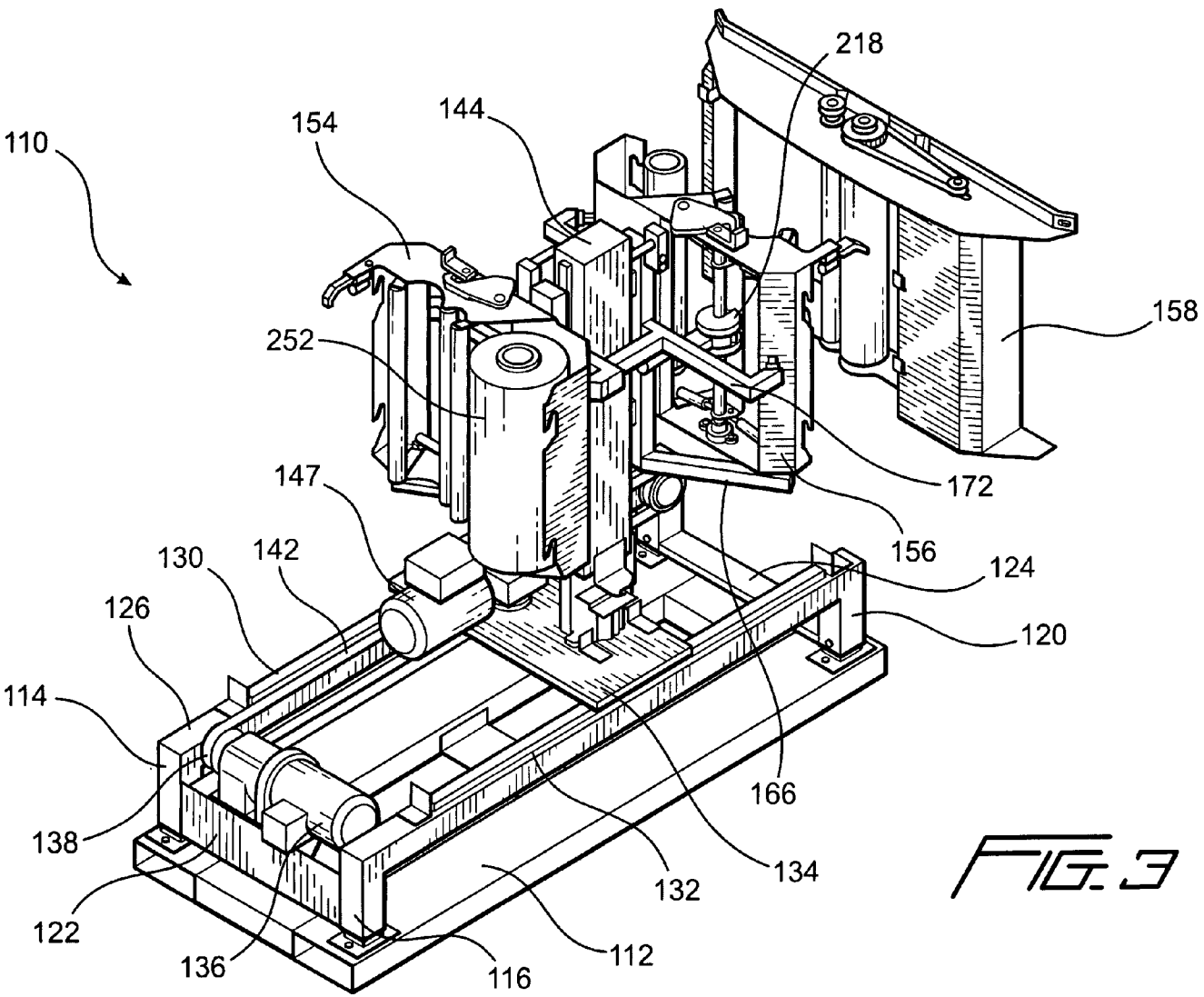
FIG. 3 is a perspective view, similar to that of FIG. 2, showing, however, the new and improved automatic film changer assembly having removed the second separable carriage assembly, having mounted thereon, for example, the core member of the depleted roll of wrapping or packaging film, from the fixed film roll mounting and dispensing carriage assembly that is mounted upon the rotary ring member of the film wrapping machine, and having mounted the second separable carriage assembly, having mounted thereon the core member of the depleted roll of wrapping or packaging film, upon the second side of the upstanding post or mast member of the automatic film changer assembly.
Figure 4:
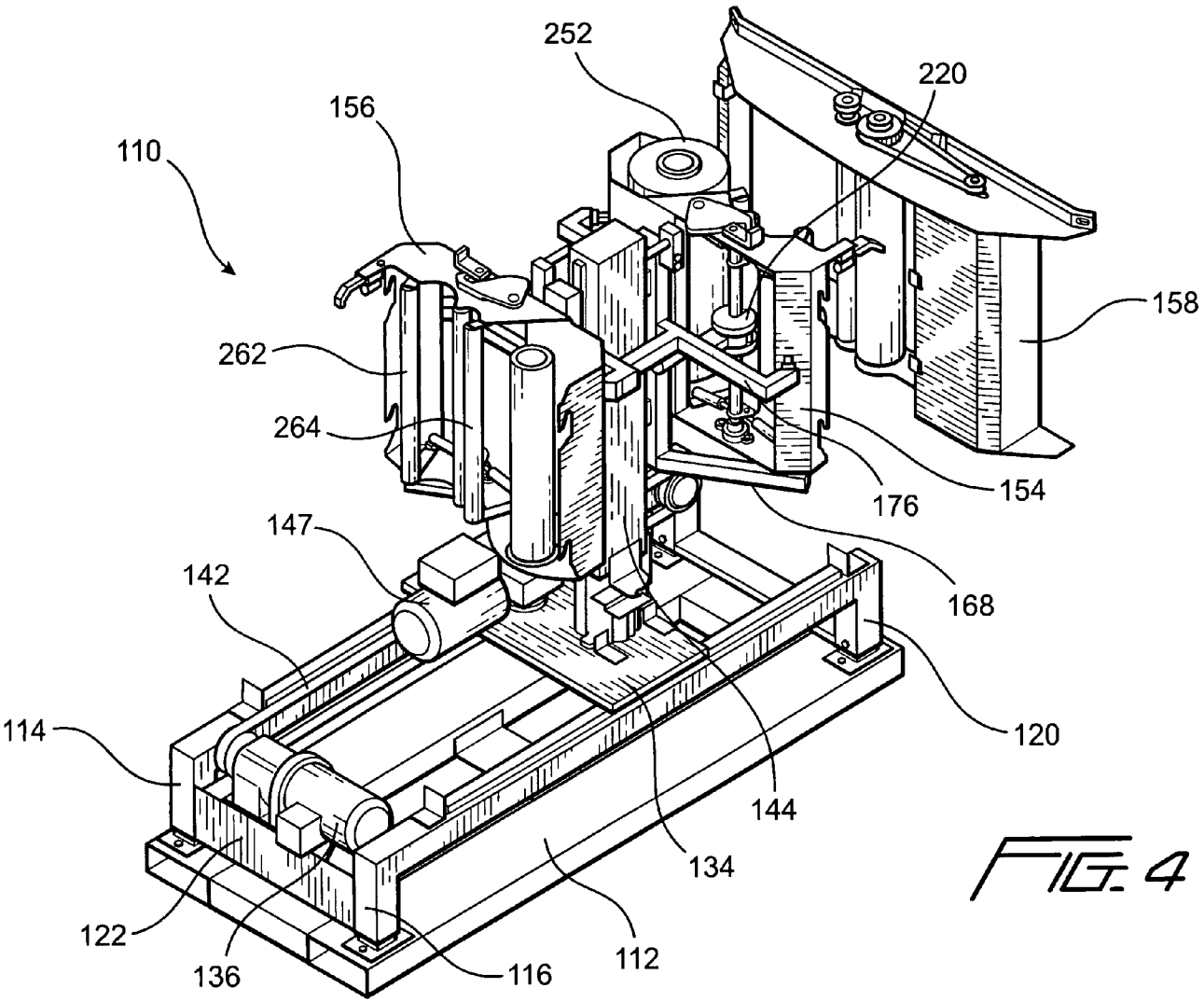
FIG. 4 is a perspective view similar to that of FIG. 3, showing, however, the upstanding post or mast member of the automatic film changer having been rotated around its axis through an angular rotation of 180° such that the second separable carriage assembly, with the core member of the depleted roll of wrapping or packaging film mounted thereon, is now disposed away from the fixed film roll mounting and dispensing carriage assembly that is mounted upon the rotary ring member of the film wrapping machine while the first separable carriage assembly, with the new or fresh roll of wrapping or packaging film mounted thereon, is now disposed toward or facing the fixed film roll mounting and dispensing carriage assembly that is mounted upon the rotary ring member of the film wrapping machine whereby the new or fresh roll of wrapping or packaging film is readied to be mounted upon the fixed film roll mounting and dispensing carriage assembly that is mounted upon the rotary ring member of the film wrapping machine when the upstanding post or mast member, disposed upon the transfer carriage assembly, is moved longitudinally toward the fixed film roll mounting and dispensing carriage assembly that is mounted upon the rotary ring member of the film wrapping machine.

Continuing still further, and with particular reference being made to FIGS. 2 and 8-10, a pair of support arm assemblies 150,152, for respectively supporting and transferring first and second substantially identical separable carriage assemblies 154,156 which are best seen in FIGS. 3 and 4, are mounted upon opposite sides of the upstanding post or mast 144, and it is to be appreciated that the support plate 134, the upstanding post or mast 144, and the pair of support arm assemblies 150,152 effectively comprise a transfer assembly for transferring the first and second separable carriage assemblies 154,156 toward and away from a fixed film roll mounting and dispensing carriage assembly 158, best seen in FIGS. 3 and 4, that is mounted upon the rotary ring member of the film wrapping machine, so as to perform an automatic film change operation as will be more fully discussed hereinafter. More particularly, as can best be appreciated from FIG. 10, it is seen that each one of the pair of support arm assemblies 150,152 comprises a vertically oriented main arm member 160,162, a pair of lower support arms 164,166 and 168,170 respectively connected to lower end portions of the main arm members 160,162 and disposed at predetermined angles with respect to the vertically oriented main arm members 160,162 such that each pair of support arms 164,166 and 168, 170 are disposed at an angle of, for example, 90° with respect to each other, and a pair of upper support arms 172,174 and 176,178 respectively connected to upper end portions of the main arm members 160,162.

Figure 8:
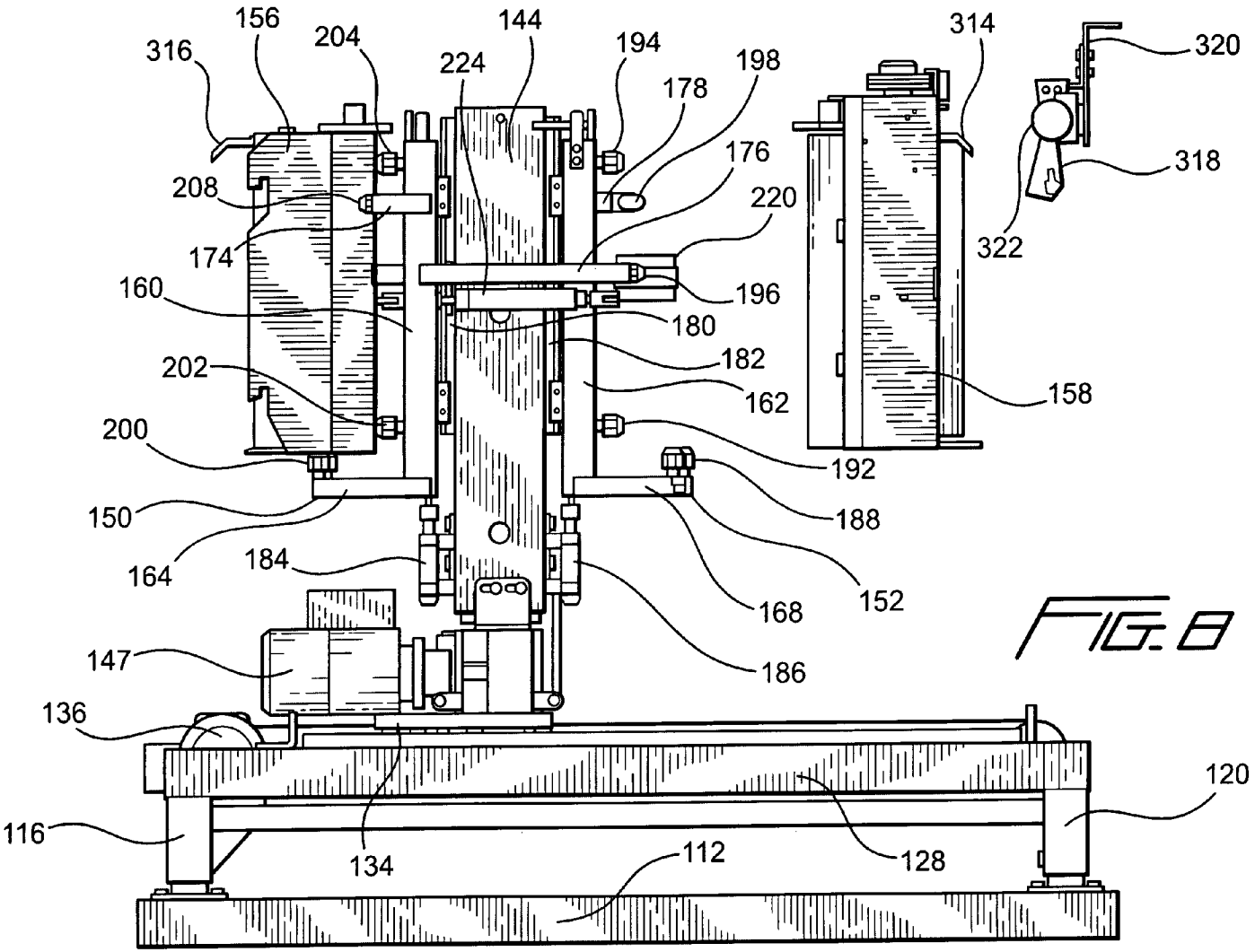
FIG. 8 is a side elevational view, substantially corresponding to FIG. 7, of the new and improved automatic film changer assembly, the fixed film roll mounting and dispensing carriage assembly that is mounted upon the rotary ring member of the film wrapping machine, and the automatic film changer clamping mechanism, which is disposed upon the rotary ring member of the film wrapping machine, wherein the automatic film changer clamping mechanism is illustrated as being readied for grasping the film tail of the new or fresh roll of wrapping or packaging film from the film tail holder mechanism of the first separable carriage assembly.
Figure 9:
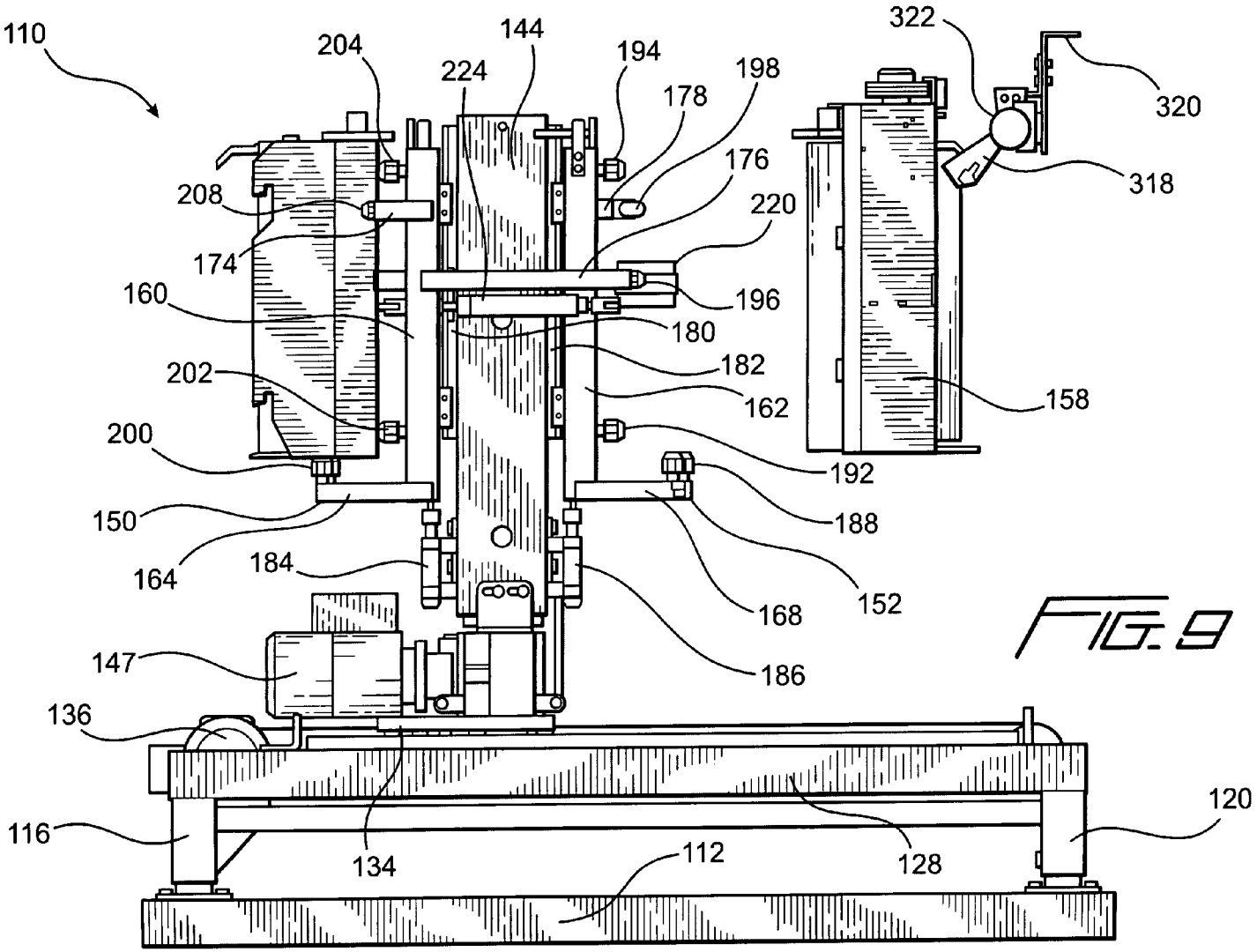
FIG. 9 is a side elevational view similar to that of FIG. 8, showing, however, the automatic film changer clamping mechanism having been moved toward its first extreme position at which the same grasps the film tail of the new or fresh roll of wrapping or packaging film in preparation for removing the same from the film tail holder mechanism of the first separable carriage assembly.

As can best be seen in FIGS. 8 and 9, the pair of support arm assemblies 150,152 are adapted to be vertically movable with respect to the upstanding post or mast 144 in order to attain different elevational positions, and in order to achieve such vertical movements of the pair of support arm assemblies 150,152, the vertically oriented main arm members 160,162 are mounted upon opposite sides of the upstanding post or mast 144 through means of linear bearing assemblies 180, 182. In order to control the vertical or elevational dispositions of the pair of support arm assemblies 150,152 with respect to the upstanding post or mast 144, a pair of pneumatic piston-cylinder assemblies 184,186 are respectively mounted upon lower end portions of the upstanding post or mast 144 and are operatively connected to undersurface lower end portions of the vertically oriented main arm members 160, 162. In addition, as can best be seen in FIG. 10, it is also seen the distal end portions of the lower support arms 168,170 of the support arm assembly 152 are respectively provided with upstanding knobs, feelers, or projections 188,190, while the vertically oriented main arm member 162 is similarly provided with a pair of vertically spaced, horizontally oriented knobs, feelers, or projections 192,194, and the pair of upper support arms 176,178 are likewise provided with a pair of laterally spaced, horizontally oriented knobs, feelers, or projections 196,198.

Figure 10:
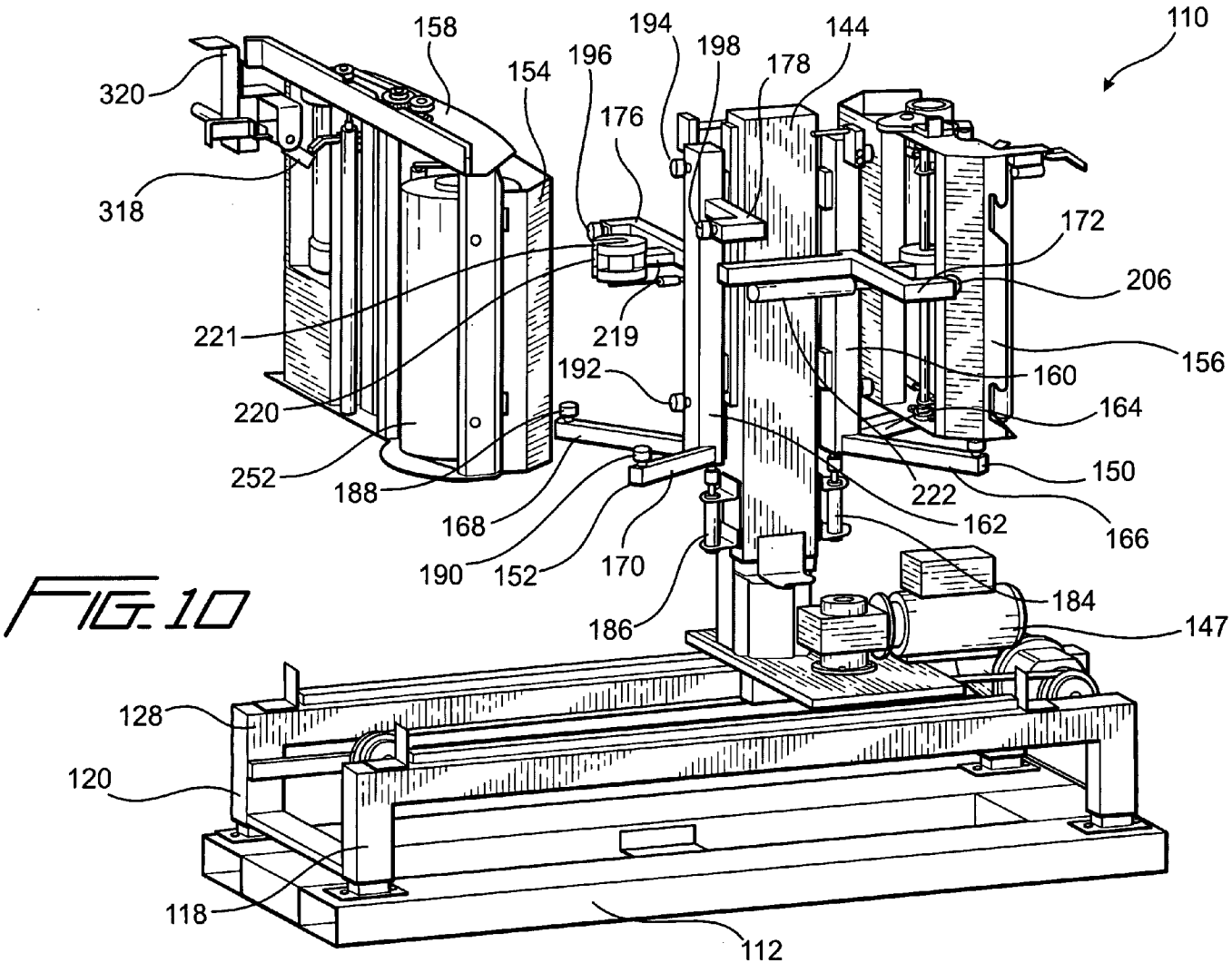
FIG. 10 is a side perspective view similar to FIG. 9, but viewed from the opposite side of the automatic film changer assembly, showing the automatic film changer clamping mechanism having been pivotally moved away from its first extreme position adjacent to the film tail holder mechanism of the first separable carriage assembly, and moved to its second extreme position so as to retain the film tail of the new or fresh roll of wrapping or packaging film during the commencement of a film wrapping or packaging operation comprising the withdrawal of the wrapping or packaging film from the new or fresh roll of film mounted upon the first separable carriage assembly which is, in turn, mounted upon the fixed film roll mounting and dispensing carriage assembly that is mounted upon the rotary ring member of the film wrapping machine.

Correspondingly, as can best be appreciated from FIGS. 8-10, the distal end portions of the lower support arms 164, 166 of the support arm assembly 150 are respectively provided with upstanding knobs, feelers, or projections, although only one such knob, feeler, or projection 200 is visible, while the vertically oriented main arm member 160 is similarly provided with a pair of vertically spaced, horizontally oriented knobs, feelers, or projections 202,204, and the pair of upper support arms 172,174 are likewise provided with a pair of laterally spaced, horizontally oriented knobs, feelers, or projections 206,208. As can best be appreciated from, for example, FIGS. 8-10, the upstanding knobs, feelers, or projections 188,190, and 200, disposed upon the lower pairs of support arms 164,166 and 168,170, are adapted to be disposed beneath the respective ones of the first and second separable carriage assemblies 154,156 so as to vertically support the same, the vertically spaced knobs, feelers, or projections 192,194 and 202,204, respectively disposed upon the vertically oriented main arm members 160,162, are adapted to engage rear surface portions of the first and second separable carriage assemblies 154,156, and the various horizontally oriented knobs, feelers, or projections 196,198 and 206, 208, respectively disposed upon the distal end portions of the upper support arms 176,178 and 172,174, are adapted to engage side wall surface portions of the first and second separable carriage assemblies 154,156 so as to adequately support and stabilize the first and second separable carriage assemblies 154,156 when they are respectively mounted upon the first and second support arm assemblies 150,152.

Figure 5:
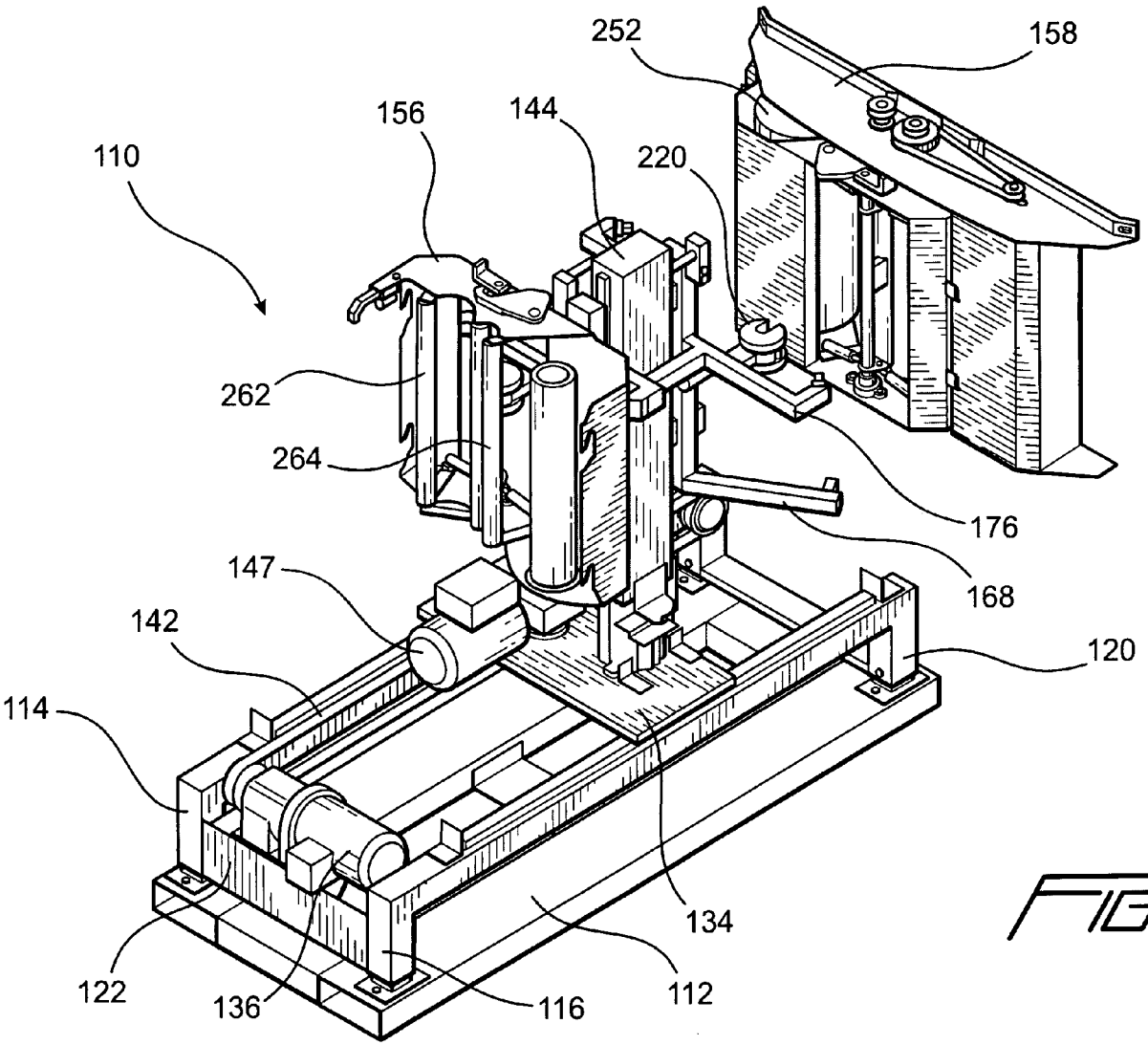
FIG. 5 is a perspective view, similar to that of FIG. 4, wherein, however, the new and improved automatic film changer has now mounted the first separable carriage assembly, having mounted thereon the new or fresh roll of wrapping or packaging film, upon the fixed film roll mounting and dispensing carriage assembly that is mounted upon the rotary ring member of the film wrapping machine, and wherein further, the upstanding post or mast member has been longitudinally moved or retracted away from the fixed film roll mounting and dispensing carriage assembly that is mounted upon the rotary ring member of the film wrapping machine.
Figure 5A:
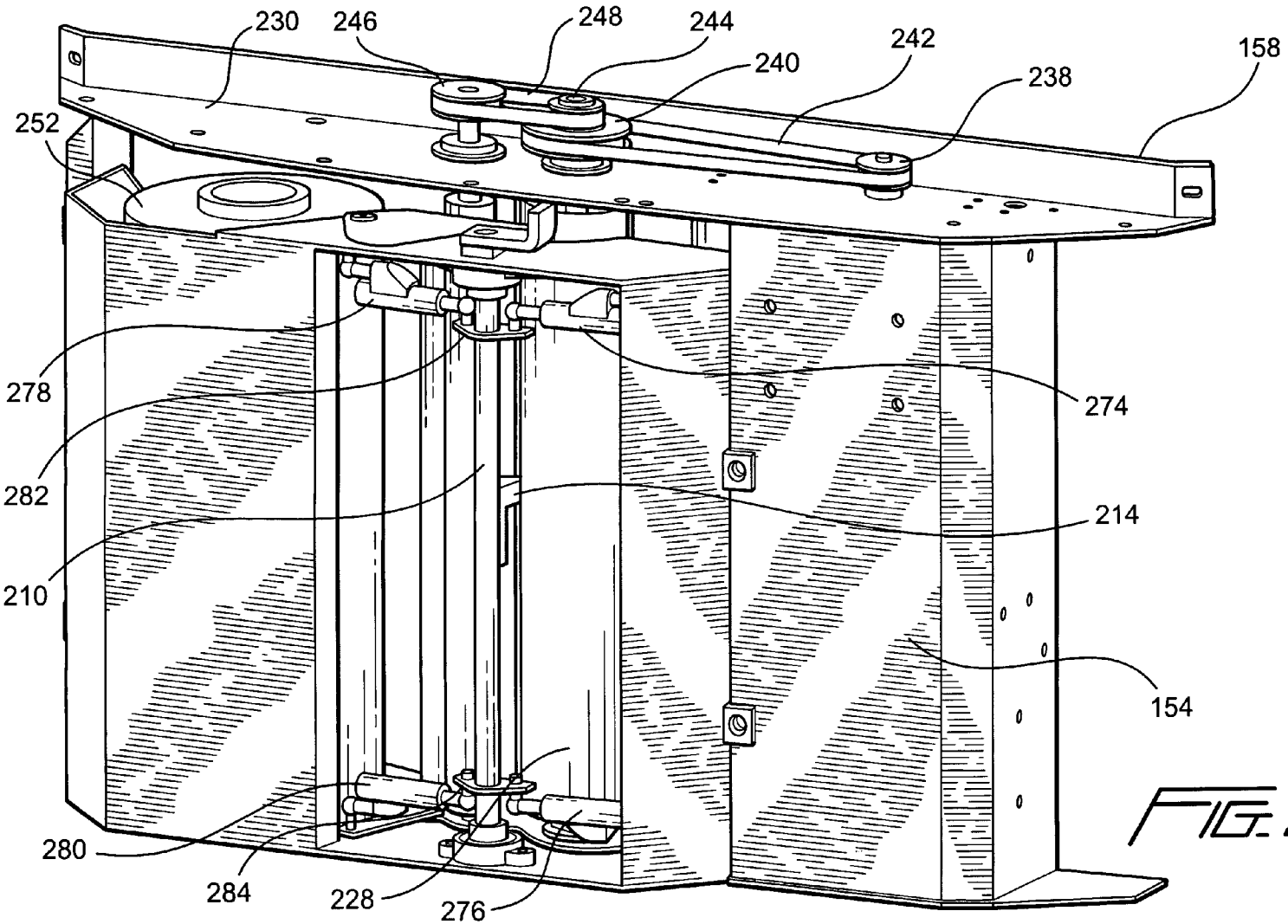
FIG. 5*a* is an enlarged perspective view showing the first separable carriage assembly fixedly mounted upon the fixed film roll mounting and dispensing carriage assembly that is mounted upon the rotary ring member of the film wrapping machine.

Continuing still further, and with reference again being made to FIG. 2, in order to actually grip or grasp, for example, the second separable carriage assembly 156 so as to remove the same from the fixed film roll mounting and dispensing carriage assembly 158 that is mounted upon the rotary ring member of the film wrapping machine, not shown, and thereby, in turn, remove the core of a depleted roll of film, or, alternatively, to remove a roll of film which has experienced a breakage, from the fixed film roll mounting and dispensing carriage assembly 158 that is mounted upon the rotary ring member of the film wrapping machine, it is seen that the first and second separable carriage assemblies 154,156 are respectively provided with vertically oriented rod members 210, 212, wherein, for example, the rod member 210 of the first separable carriage assembly 154 can best be seen in FIG. 5*a*. Each one of the rod members 210,212 has a block member 214,216, having a substantially inverted L-shaped configuration, fixedly mounted thereon, and each one of the upper support arms 172,176 of the support arm assemblies 150, 152 has a vertically slotted C-clamp assembly 218,220 respectively mounted thereon, as can best be seen in FIGS. 2 and 10, which is adapted to respectively operatively engage the vertically oriented rod members 210,212 and the inverted L-shaped block members 214,216 fixedly mounted thereon.

In particular, each one of the vertically slotted C-clamp assemblies 218,220 is mounted upon its respective upper support arm 172,176 by means of an axially central, radially projecting mounting plate 219, while a substantially cylindrically shaped housing section 221 effectively encases and is rotatable with respect to the axially central, radially projecting mounting plate 219. In addition, it is also seen that each one of the upper support arms 172,176 of the support arm assemblies 150,152 has a pneumatic piston-cylinder assembly 222,224 mounted thereon wherein the distal or free end portion of the piston rod of each one of the piston-cylinder assemblies 222,224 is operatively connected to a lower peripheral or radially offset portion of the rotary housing section 221 of its respective vertically slotted C-clamp assembly 218,220. In this manner, when it is desired to remove a particular one of the first or second separable carriage assemblies 154,156 from the fixed film roll mounting and dispensing carriage assembly 158 that is mounted upon the rotary ring member of the film wrapping machine, the transfer assembly, comprising the support plate 134, the upstanding post or mast 144, and the pair of support arm assemblies 150, 152, will be moved longitudinally so as to permit the particular one of the rod members 210,212 and its associated block member 214,216 to enter the vertically slotted portion of the particular one of the C-clamp assemblies 218,220, and subsequently, the particular one of the pneumatic piston-cylinder assemblies 222,224 will be actuated so as to cause the rotary housing section 221 of the particular vertically slotted C-clamp assembly 218,220 to be pivotally moved through a predetermined angular rotation, such as, for example, 90°, with respect to its stationary mounting plate 219.

Accordingly, not only will the slotted sections of the upper and lower portions of the rotary housing section 221 of the particular one of the C-clamp assemblies 218,220 now be disposed transversely with respect to the longitudinal direction of movement of the aforenoted transfer assembly so as to effectively permit the particular one of the C-clamp assemblies 218,220 to be lockingly engaged with the particular one of the rod members 210,212, but in addition, as a result of the upper portion of the rotary housing section 221 engaging the particular one of the block members 214,216 disposed upon the particular one of the rod members 210,212, and angularly rotating the particular one of the block members 214,216 with the rotary housing section 221, the particular one of the rod members 210,212 likewise undergoes angular rotation around its own vertically oriented longitudinal axis. The operational significance of such interrelated structure and movements will become more apparent shortly hereinafter.

Before resuming the aforenoted discussion regarding the significance of the angular movement of the particular one of the rod members 210,212 around its own vertically oriented longitudinal axis, reference is made to FIGS. 3*a*, 3*b*, 3*c*, 5*a*, and 6 wherein additional structure, comprising each one of the first and second separable carriage assemblies 154,156, as well as additional structure comprising the fixed film roll mounting and dispensing carriage assembly 158 that is mounted upon the rotary ring member of the film wrapping machine, will be described so as to in fact enable or facilitate each one of the first and second separable carriage assemblies 154,156 to be mounted upon, and removed from, the fixed film roll mounting and dispensing carriage assembly 158 that is mounted upon the rotary ring member of the film wrapping machine in accordance with an automatic film change operation. More particularly, as can best be appreciated from FIG. 3*a* and FIG. 6, the fixed film roll mounting and dispensing carriage assembly 158, that is mounted upon the rotary ring member of the film wrapping machine, is seen to comprise a pair of vertically oriented pre-stretch rollers 226, 228 rotatably mounted between upper and lower horizontally oriented framework members 230,232 of the fixed film roll mounting and dispensing carriage assembly 158, and a drive motor 234 is fixedly mounted within a housing section 236 of the fixed film roll mounting and dispensing carriage assembly 158. The output drive shaft of the drive motor 234 is provided with a first drive pulley 238, and an upper end portion of the shaft or core, upon which the pre-stretch roller 228 is fixedly mounted, is provided with a first driven pulley 240 so as to be driven by the first drive pulley 238 through means of a first endless drive belt 242 disposed around the first drive and driven pulleys 238,240. In addition, the distal or free end portion of the shaft or core, upon which the pre-stretch roller 228 is fixedly mounted, is provided with a second drive pulley 244, and an upper end portion of the core or shaft, upon which the pre-stretch roller 226 is fixedly mounted, is provided with a second driven pulley 246 so as to be driven by the second drive pulley 244 through means of a second endless drive belt 248 disposed around the second drive and driven pulleys 244,246.

Figure 3A:
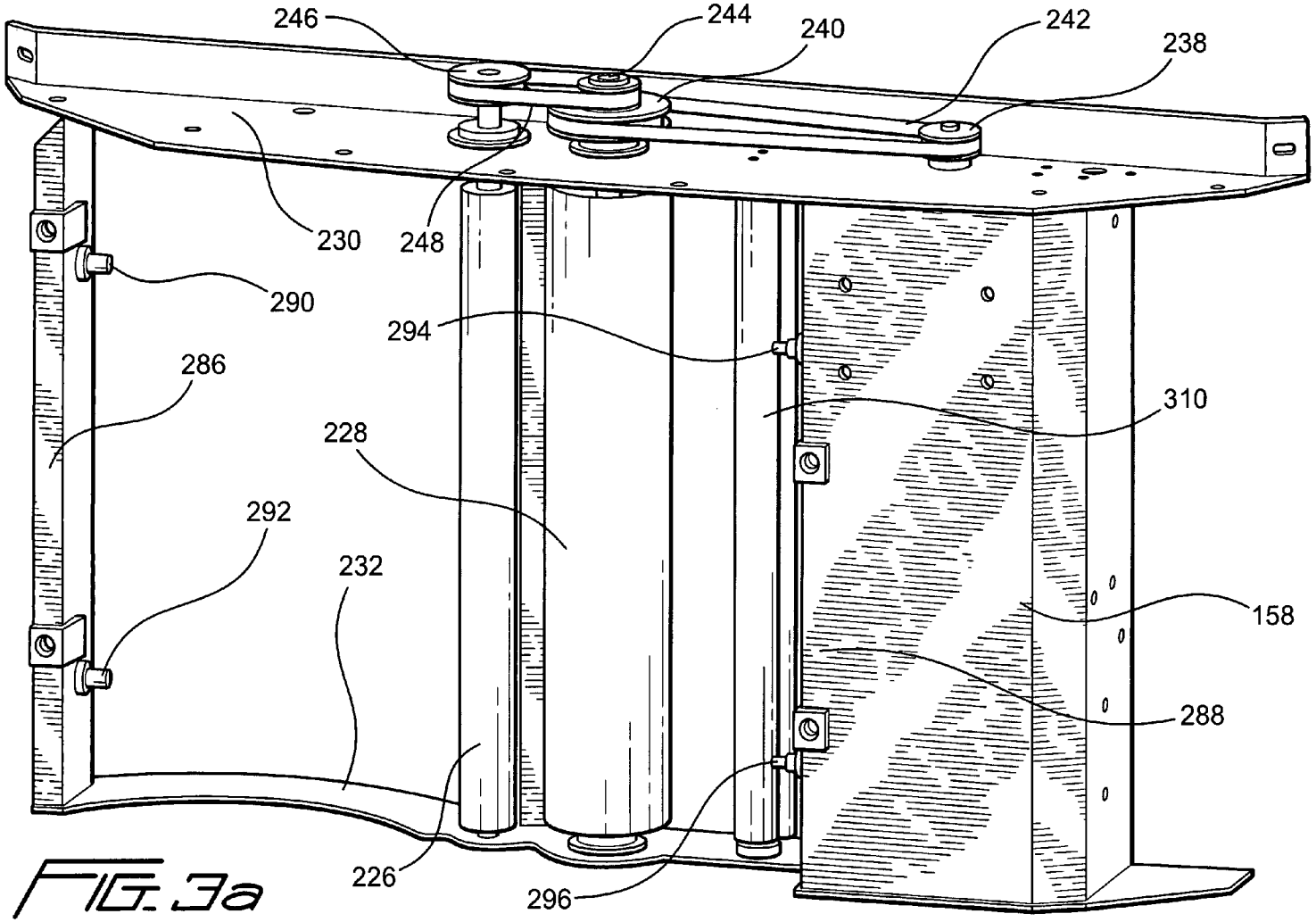
FIG. 3*a* is an enlarged perspective view of the fixed film roll mounting and dispensing carriage assembly that is mounted upon the rotary ring member of the film wrapping machine.
Figure 3B:
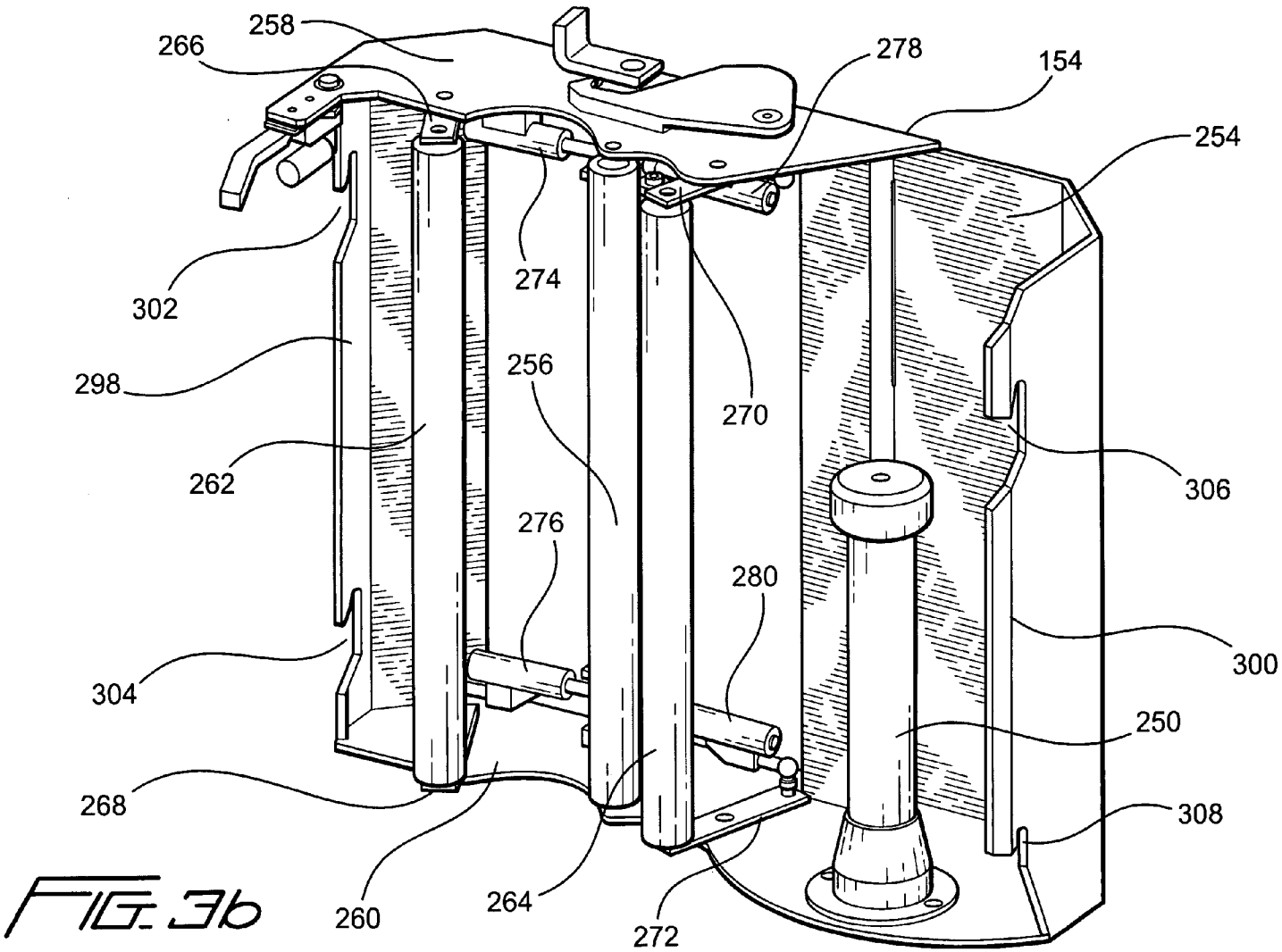
FIG. 3*b* is an enlarged perspective view of the first separable carriage assembly without a new or fresh roll of wrapping or packaging film being disposed thereon.
Figure 3C:
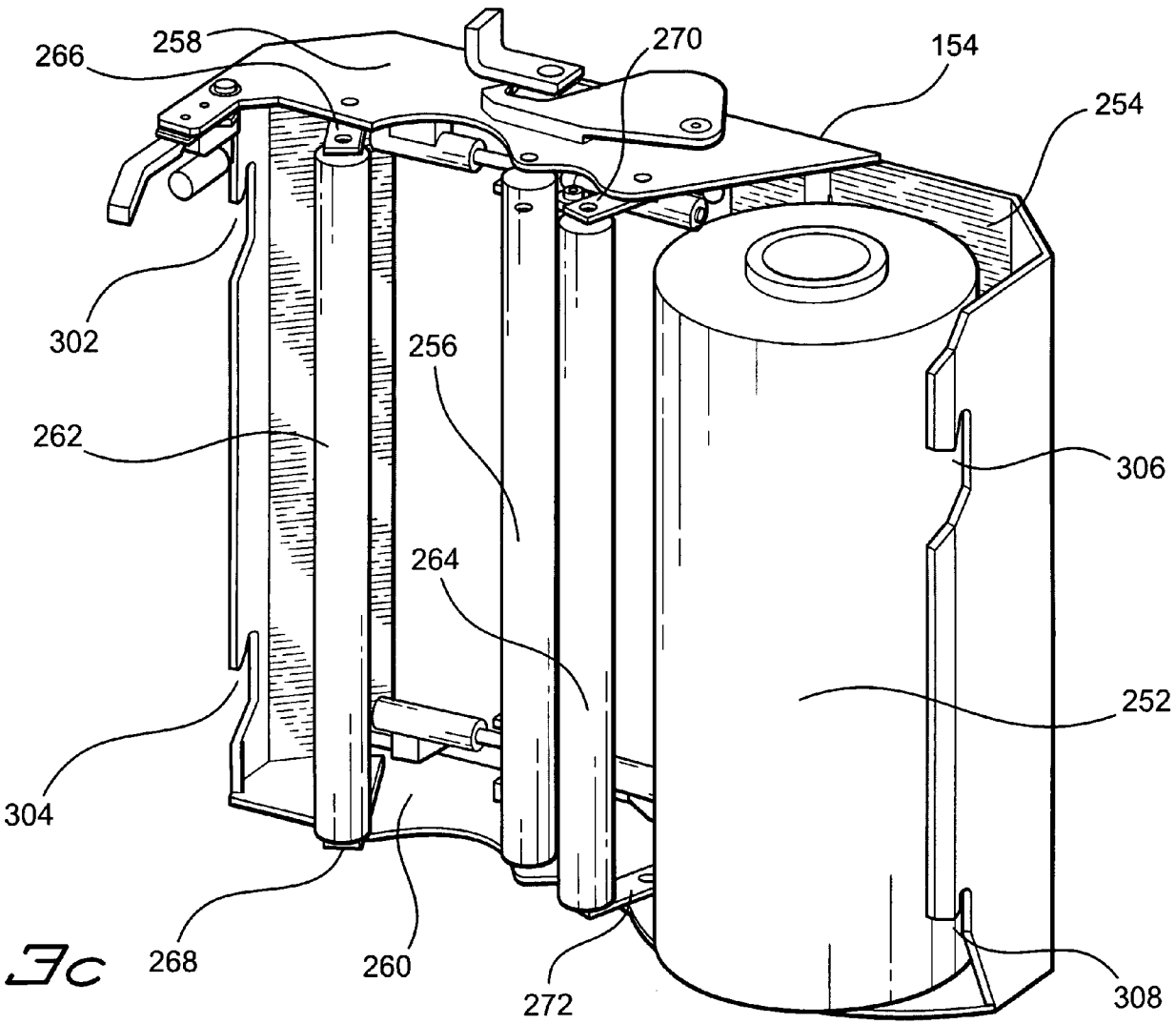
FIG. 3*c* is an enlarged perspective view of the first separable carriage assembly, as disclosed within FIG. 3*b*, showing a new or fresh roll of wrapping or packaging film being disposed thereon.

With reference now being made more specifically to FIGS. 3*b*, 3*c*, and 5*a*, the structural components of the first separable carriage assembly 154, that are pertinent to the operation of the automatic film changer 110 of the present invention, as well as additional structure comprising the first separable carriage assembly 154 which will enable or facilitate each one of the first and second separable carriage assemblies 154,156 to be mounted upon, and removed from, the fixed film roll mounting and dispensing carriage assembly 158 that is mounted upon the rotary ring member of the film wrapping machine in accordance with an automatic film change operation, will now be described, it being appreciated that in view of the fact that the first and second separable carriage assemblies 154,156 are substantially identical to each other, the description of the structural components of the first separable carriage assembly 154 likewise applies to the second separable carriage assembly 156. More particularly, it is seen that an upstanding spool 250, upon which a roll of wrapping or packaging film 252 is adapted to be disposed, is fixedly mounted within a housing section 254 of the first separable carriage assembly 154. In addition, a vertically oriented idle roller 256 has its opposite ends rotatably mounted within upper and lower horizontally oriented framework members 258,260 of the first separable carriage assembly 154, and a pair of pressure rollers 262,264 are respectively pivotally mounted upon the upper and lower horizontally oriented framework members 258,260 of the first separable carriage assembly 154 as a result of being mounted upon first end portions of pivotally mounted bracket members 266,268 and 270,272.

In addition, as can best be appreciated from FIG. 3*b*, the opposite second end portions of the mounting brackets 266, 268 are pivotally connected to cylinder end portions of a pair of vertically spaced, spring biased or spring loaded piston-cylinder assemblies 274,276, and in a similar manner, the opposite second end portions of the mounting brackets 270, 272 are pivotally connected to cylinder end portions of a pair of vertically spaced, spring biased or spring loaded piston-cylinder assemblies 278,280. Furthermore, as can best be appreciated from FIG. 5*a*, the piston rod end portions of the piston-cylinder assemblies 274,278 are pivotally connected to a first circular or oval-shaped mounting bracket 282 which is fixedly mounted upon an upper end portion of the vertically oriented rod member 210, while the piston rod end portions of the piston-cylinder assemblies 276,280 are pivotally connected to a second circular or oval-shaped mounting bracket 284 which is also fixedly mounted upon a lower end portion of the vertically oriented rod member 210. In addition, as can be further appreciated from FIG. 5*a*, when the first separable carriage assembly 154 is mounted upon the fixed film roll mounting and dispensing carriage assembly 158 that is mounted upon the rotary ring member of the film wrapping machine, the idle roller 256 and the spring-biased pressure rollers 262,264, disposed upon the first separable carriage assembly 154, will effectively cooperate with the prestretch rollers 226,228, disposed upon the fixed film roll mounting and dispensing carriage assembly 158, in a manner well-known in the art, so as to define, in effect, a sinusoidal path along which the wrapping or packaging film is conducted or routed so as to be capable of being appropriately pre-stretched and wrapped around the article, package, or palletized load with a predetermined amount of tension.

Accordingly, it can now be appreciated that when, for example, a roll of wrapping or packaging film 252, mounted upon the second separable carriage assembly 156, has experienced a breakage, or when, for example, the roll of wrapping or packaging film 252, mounted upon the second separable carriage assembly 156, has been depleted, and when, in addition, the first separable carriage assembly 154, having a new or fresh roll of wrapping or packaging film 252 mounted thereon, is to mounted upon the fixed film roll mounting and dispensing carriage assembly 158, it is necessary to effectively move the pressure rollers 262,264 from their cooperative positions with respect to the pre-stretch rollers 226, 228. This mode of operation is accomplished by means of the aforenoted significant angular rotation of the vertically oriented rod member 210 and the L-shaped block member 214 disposed thereon, as a result of the angular rotation of the rotary housing section 221 of the C-clamp assembly 218 by means of the pneumatic piston-cylinder assemblies 222,224, and the consequent activation of the spring-loaded or spring-biased piston-cylinder assemblies 274,276,278,280 as a result of the angular rotation of the vertically oriented rod member 210 and the operative connections of the spring-loaded or spring-biased piston-cylinder assemblies 274,276, 278,280 to both the vertically oriented rod member 210 and the pressure rollers 262,264.

It is lastly noted in connection with the actual mounting of, for example, the first separable carriage assembly 154 upon the fixed film roll mounting and dispensing carriage assembly 158, or alternatively, in connection with the removal of the second separable carriage assembly 156 from the fixed film roll mounting and dispensing carriage assembly 158, and as can best be appreciated from FIGS. 3*a*-3*c*, that laterally or transversely spaced, vertically oriented framework members 286,288 of the fixed film roll mounting and dispensing carriage assembly 158 are respectively provided with upper and lower sets of mounting pins 290,292 and 294,296, and that side wall members 298,300 of, for example, the first separable carriage assembly 154 are respectively provided with upper and lower sets of slots 302,304 and 306,308. In this manner, when, for example, the first separable carriage assembly 154 is to be mounted upon or removed from the fixed film roll mounting and dispensing carriage assembly 158, as disclosed within FIGS. 5, 5*a*, and 6-10, the vertical disposition of the first separable carriage assembly 154, with respect to the fixed film roll mounting and dispensing carriage assembly 158, will effectively be controlled by means of the pneumatic piston-cylinder assembly 186 disposed beneath the support arm assembly 152 whereby the first separable carriage assembly 154 can effectively be operatively mated with, or disconnected from, the fixed film roll mounting and dispensing carriage assembly 158 by means of bayonet-type connections defined between the aforenoted sets of mounting pins 290-296 disposed upon the fixed film roll mounting and dispensing carriage assembly 158 and the slots 302-308 defined within the side wall members 298 and 300 of the first separable carriage assembly 154.

Having described substantially all of the structure characteristic of, or comprising, the new and improved automatic film changer 110 of the present invention, a brief cyclic operation of the new and improved automatic film changer 110 of the present invention will now be described. More particularly, as can best be seen from FIG. 3*a*, in addition to the pair of vertically oriented pre-stretch rollers 226,228 mounted upon the fixed film roll mounting and dispensing carriage assembly 158 that is mounted upon the rotary ring member of the film wrapping machine, the fixed film roll mounting and dispensing carriage assembly 158 also comprises a tension roller 310 which is adapted to sense the tension of the wrapping or packaging film which is being routed through the fixed film roll mounting and dispensing carriage assembly 158 and which is conducted toward the package being wrapped or packaged. More particularly, as is known in the art, the tension roller 310 contains suitable electronic mechanisms, such as, for example, a strain gauge, or the like, for in fact sensing the tension of the wrapping or packaging film. Accordingly, if the wrapping or packaging film disposed upon the particular roll of wrapping or packaging film 252 becomes depleted, or experiences breakage, the tension roller 310 obviously senses a substantial decrease in the sensed tension load or value, that is, the sensed tension load or value will effectively be zero, whereby, in either case, that is, either the depletion of the wrapping or packaging film or the breakage of the wrapping or packaging film, replacement of the original roll of wrapping or packaging film 252 will be necessitated.

Accordingly, the detected occurrence of the substanstantially reduced or zero tension value, by means of the tension roller 310 disposed upon the fixed film roll mounting and dispensing carriage assembly 158, is transmitted, in effect, as an error signal to a programmable logic controller (PLC) 312, which is schematically illustrated in FIG. 2 and which automatically controls all movements of all of the pertinent movable components of the new and improved automatic film changer assembly 110, so that the programmable logic controller (PLC) 312 can initiate a wrapping or packaging film exchange operation. More particularly, even before the need arises to initiate a wrapping or packaging film exchange operation, a new or fresh roll of wrapping or packaging film 252 is mounted, for example, upon the first separable carriage assembly 154, as illustrated within FIG. 2, in preparation for a wrapping or packaging film exchange operation when in fact the need for such a wrapping or packaging film exchange operation does in fact arise.

Figure 1:
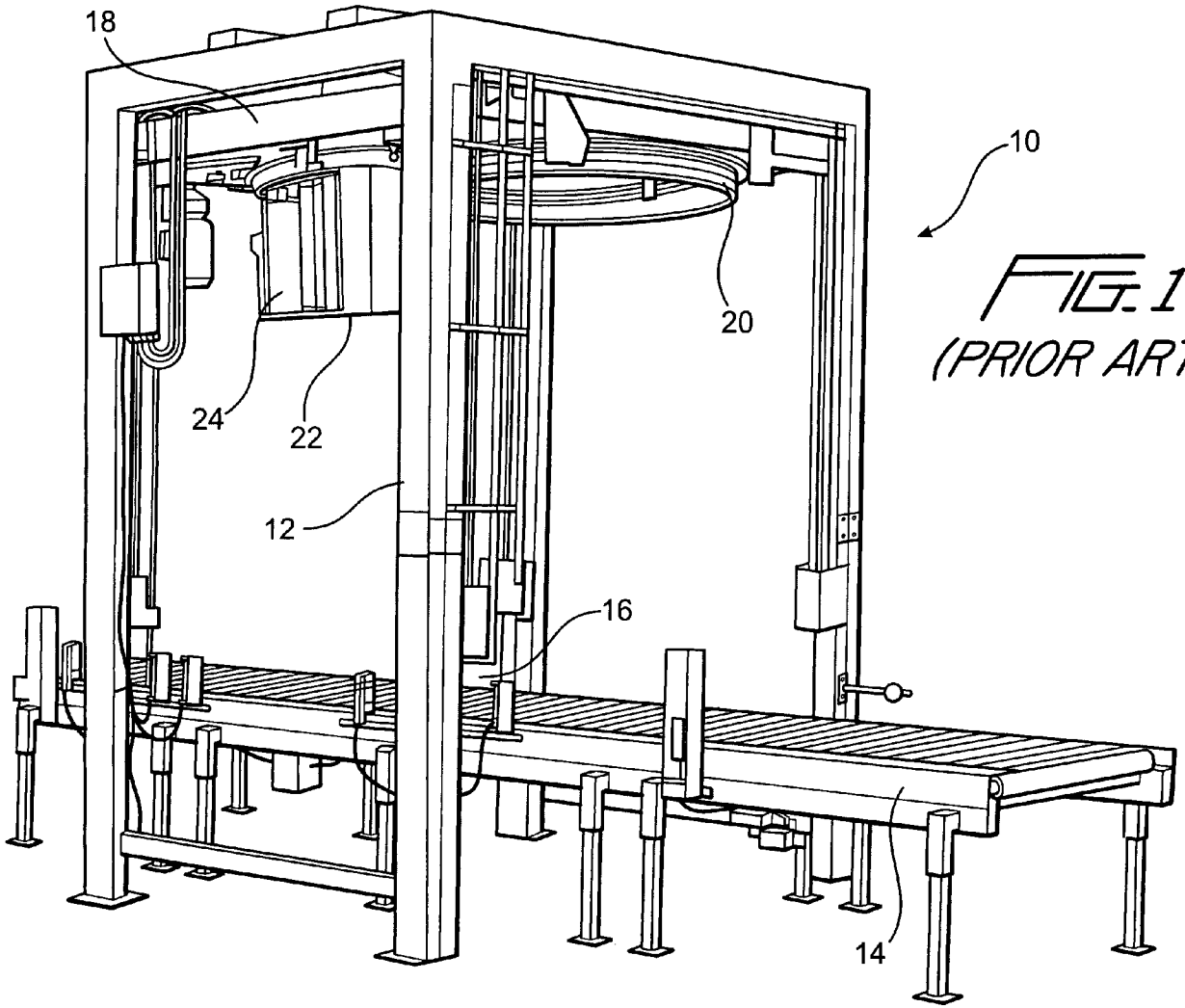
FIG. 1 (PRIOR ART)
FIG. 1 is a perspective view of a conventional, PRIOR ART film wrapping machine.

Accordingly, when the need for such a wrapping or packaging film exchange operation does in fact arise, as when the programmable logic controller (PLC) 312 receives the aforenoted error signal from the tension roller 310, the programmable logic controller (PLC) 312 will actuate the first reversible drive motor 136 so as to accordingly move the support plate 134, along its linear bearings 130,132, toward the fixed film roll mounting and dispensing carriage assembly 158 upon which the second separable carriage assembly 156, having a depleted roll of wrapping or packaging film 252, or a roll of wrapping or packaging film 252 which has experienced a breakage in its wrapping or packaging film, is disposed. It is also to be noted that the programmable logic controller (PLC) 312 will also actuate the pair of pneumatic piston-cylinder assemblies 184,186, respectively mounted upon the lower end portions of the upstanding post or mast 144, so as to control the elevation of the support arm assemblies 150,152 in order to position the vertically oriented main arm members 160,162, and the various operative components mounted thereon, to a predetermined elevational level which corresponds to the elevational level at which the fixed film roll mounting and dispensing carriage assembly 158 and the second separable carriage assembly 156, having the depleted roll of wrapping or packaging film 252, or the roll of wrapping or packaging film 252 which has experienced a breakage in its wrapping or packaging film mounted thereon, is disposed upon the fixed, four-post, upstanding framework similar to that as illustrated at 12 within FIG. 1.

As the upstanding post or mast 144, and the vertically oriented main arm members 160,162 mounted thereon, approaches the fixed film roll mounting and dispensing carriage assembly 158 and the second separable carriage assembly 156 mounted thereon, as a result of the aforenoted longitudinal translational movement of the support plate 134 as illustrated within FIG. 2, the C-clamp assembly 218, mounted upon the upper support arm 172, will engage the block member 216 fixedly mounted upon the rod member 212, and upon actuation of the pneumatic piston-cylinder assembly 222, as illustrated within FIG. 10, the C-clamp assembly 218 and the rod member 212 will effectively be rotated 90° such that the C-clamp assembly 218 will now be disposed transversely or perpendicular to the longitudinal translational directional movement of the support plate 134 in order to effectively firmly grasp the same. In addition, as a result of the rotation of the rod member 212, the pressure rollers 262,264 of the second separable carriage assembly 156 will be moved away or operatively disengaged from the pre-stretch rollers 226, 228 of the fixed film roll mounting and dispensing carriage assembly 158. Furthermore, as a result of the vertical movement of the vertically oriented main arm member 160, the vertically spaced knobs, feelers, or projections 202,204 disposed upon the vertically oriented main arm member 160 are adapted to engage rear surface portions of the second separable carriage assembly 156, the pair of laterally spaced, horizontally oriented knobs, feelers, or projections 206, 208 of the pair of upper support arms 172,174 are adapted to engage side wall surface portions of the second separable carriage assembly 156, and the upstanding knobs, feelers, or projections disposed upon the lower pairs of support arms 164,166, wherein it is noted that only knob, feeler, or projection 200 is visible, are adapted to be disposed beneath the second separable carriage assembly 156 so as to vertically support and horizontally stabilize the second separable carriage assembly 156 upon the support arm assembly 150. Still yet further, once the second separable carriage assembly 156 has been grasped, supported, and stabilized by means of the variously aforenoted components, further actuation of the pneumatic piston-cylinder assembly 184 will elevate the support arm assembly 150, and the various support arms 164, 166,172,174 thereof, still further so as to effectively remove the second separable carriage assembly 156 from the fixed film roll mounting and dispensing carriage assembly 158 as a result of the disengagement of the slotted portions 302-308 of the second separable carriage assembly 156 from the mounting pins 290-296 of the fixed film roll mounting and dispensing carriage assembly 158.

Having removed the second separable carriage assembly 156 from the fixed film roll mounting and dispensing carriage assembly 158, the programmable logic controller (PLC) 312 then issues a command signal to the first reversible drive motor 136 so as to operate the same in a reverse directional mode and thereby effectively move the support plate 134 a predetermined distance away from the fixed film roll mounting and dispensing carriage assembly 158 as illustrated within FIG. 3. Subsequently, the programmable logic controller (PLC) 312 will issue a command signal to the second reversible drive motor 147 so as to cause the same to rotate the upstanding post or mast 144 through an angular orientation of 180° whereby, as can best be appreciated from FIG. 4, the second separable carriage assembly 156, having the core member of the depleted roll of wrapping or packaging film mounted thereon, is now disposed or faces away from the fixed film roll mounting and dispensing carriage assembly 158 while the first separable carriage assembly 154, having the new or fresh roll of wrapping or packaging film 252 mounted thereon, is now disposed toward or faces the fixed film roll mounting and dispensing carriage assembly 158.

Subsequently still further, the programmable logic controller (PLC) 312 will issue a command signal to the first reversible drive motor 136 so as to effectively move the support plate 134 toward the fixed film roll mounting and dispensing carriage assembly 158 so as to cause the upstanding post or mast 144, and the first separable carriage assembly 154 mounted thereon, to approach the fixed film roll mounting and dispensing carriage assembly 158. As the first separable carriage assembly 154 nears the fixed film roll mounting and dispensing carriage assembly 158 and effectively mates with or is about to engage the fixed film roll mounting and dispensing carriage assembly 158 so as to be mounted thereon, the programmable logic controller (PLC) 312 will also suitably control, in a coordinated manner, the pneumatic piston-cylinder assembly 186 so as to timely permit the first separable carriage assembly 154 to in fact be vertically lowered and mounted upon the fixed film roll mounting and dispensing carriage assembly 158 by means of the bayonet connections defined between the plurality of slotted portions 302-308 of the first separable carriage assembly 154 and the mounting pins 290-296 of the fixed film roll mounting and dispensing carriage assembly 158. It is to be noted that when the fresh or new roll of wrapping or packaging film 252 is initially placed upon the upstanding spool or mandrel 250 of the first separable carriage assembly 154, the leading end portion or film tail of the new or fresh roll of wrapping or packaging film 252 will be manually placed within a film tail holder 314 which is provided upon the first separable carriage assembly 154 as can best be seen in FIGS. 3*b*, 3*c*, and 8.

Wrapping or packaging film will therefore extend from the new or fresh roll of wrapping or packaging film 252, across the pressure rollers 262,264, and be held within the film tail holder 314. Accordingly, once the first separable carriage assembly 154 has been mounted upon the fixed film roll mounting and dispensing carriage assembly 158, the leading end portion of the wrapping or packaging film, extending from the new or fresh roll of wrapping or packaging film 252, across the pressure rollers 262,264, and to the film tail holder 314, will effectively be automatically interposed between the pressure rollers 262,264 of the first separable carriage assembly 154 and the pre-stretch rollers 226,228 of the fixed film roll mounting and dispensing carriage assembly 158, since the pressure rollers 262,264 of the first separable carriage assembly 154 are still disposed at their disengaged position with respect to the pre-stretch rollers 226, 228 of the fixed film roll mounting and dispensing carriage assembly 158 by means of the C-clamp assembly 220. It is of course also noted that a corresponding film tail holder 316 is likewise provided upon the second separable carriage assembly 156, as can also be seen in FIG. 8, in view of the fact that the first and second separable carriage assemblies 154,156 are substantially identical.

Upon conclusion of the physical mounting of the first separable carriage assembly 154 upon the fixed film roll mounting and dispensing carriage assembly 158, the programmable logic controller (PLC) 312 will issue a command signal to the pneumatic piston-cylinder assembly 224 so as to effectively return the C-clamp assembly 220 to its disengaged position with respect to the rod member 210, as well as to permit the pressure rollers 262,264 of the first separable carriage assembly 154 to be moved from their disengaged position with respect to the pre-stretch rollers 226,228 of the fixed film roll mounting and dispensing carriage assembly 158 to their operatively engaged position with respect to the pre-stretch rollers 226,228 of the fixed film roll mounting and dispensing carriage assembly 158. In this manner, the automatic film changer assembly 110 is able to be disengaged from the first separable carriage assembly 154 which is now fixedly mounted upon the fixed film roll mounting and dispensing carriage assembly 158, and in addition, the pressure rollers 262,264 of the first separable carriage assembly 154 are able to operatively cooperate with the pre-stretch rollers 226,228 of the fixed film roll mounting and dispensing carriage assembly 158 so as to define a sinusoidal path along which the wrapping or packaging film is effectively routed so as to be properly conveyed through the fixed film roll mounting and dispensing carriage assembly 158 with a predetermined amount of pre-stretch and tension in accordance with a wrapping or packaging film dispensing operation.

Still yet further, the programmable logic controller (PLC) 312 will issue a command signal to the first reversible drive motor 136 so as to effectively move the support plate 134 in a reverse or retracted direction away from the fixed film roll mounting and dispensing carriage assembly 158. The first separable carriage assembly 154 is illustrated as being fixedly mounted upon the fixed film roll mounting and dispensing carriage assembly 158 within FIGS. 5 and 6, and the support plate 134 is illustrated as having been moved to any one of several retracted positions as illustrated within FIGS. 5 and 7-10. This concludes the wrapping or packaging film exchange operation although it is noted still further that in order to effectively move or position the leading end or film tail portion of the new or fresh roll of wrapping or packaging film 252 from the film tail holder 314 to a position at which the film wrapping cycle or operation can be commenced or resumed, an auxiliary film clamp mechanism 318, as illustrated within FIGS. 7-10, is utilized. More particularly, the auxiliary film clamp mechanism 318 is adapted to be pivotally mounted upon a transversely oriented, movable beam member, not illustrated but adapted to be disposed adjacent to the rotary ring member of the wrapping or packaging machine as more particularly described within co-pending patent application entitled FILM WRAPPING MACHINE SIMULTANEOUSLY UTILIZING TWO FILM CARRIAGE ASSEMBLIES, Ser. No. 12/461,755 which is a continuation of patent application entitled FILM WRAPPING MACHINE SIMULTANEOUSLY UTILIZING TWO FILM CARRIAGE ASSEMBLIES, Ser. No. 11/723,219, abandoned, which is hereby incorporated herein by reference, by means of a suitable support bracket 320, and while the auxiliary film clamp mechanism 318 is illustrated in FIG. 8 as being disposed, in effect, at a neutral dependent position, in actuality, the auxiliary film clamp mechanism 318 is actually movable between either one of two extreme positions under the control of the programmable logic controller (PLC) 312.

The first extreme position, to which the auxiliary clamp mechanism 318 is movable, is illustrated within, for example, FIG. 9, wherein it is seen that the auxiliary clamp mechanism 318, pivotally mounted upon a rod member 322, has been pivotally moved about the longitudinal axis of the rod member 322 through an angular orientation of approximately 65° so as to operatively engage the film tail portion of the new or fresh roll of wrapping or packaging film 252 which has been manually inserted within the film tail holder 314. When the auxiliary clamp mechanism 318 is then moved in an opposite angular position through means of an angular extent of approximately 135°, the film tail portion of the new or fresh roll of wrapping or packaging film 252 will be properly positioned, with respect to the article or object to be wrapped or packaged, such that a film wrapping or packaging operation can be commenced. After the commencement of the film wrapping or packaging operation, that is, after a predetermined number of wrapping or packaging film layers have been wrapped around the article or object to be wrapped or packaged, the auxiliary clamp mechanism 318 releases the film tail portion of the new or fresh roll of wrapping or packaging film 252 and is only again used in connection with the grasping of the leading end or film tail portion of a new or fresh roll of wrapping or packaging film 252 when commencement of a wrapping or packaging operation, utilizing a new or fresh roll of wrapping or packaging film 252, is to be implemented.

Thus, it may be seen that in accordance with the principles and teachings of the present invention, there has been disclosed and described a new and improved film wrapping machine which includes a new and improved film changer, operatively associated with the film wrapping machine, for automatically exchanging rolls of wrapping film, wherein a depleted roll of wrapping film, or a roll of wrapping film that has experienced a breakage in the wrapping film, can be automatically removed from the film roll mounting and dispensing carriage assembly, and wherein further, a fresh roll of wrapping film can be positionally exchanged for the depleted roll of wrapping film, or for the roll of wrapping film that has experienced the breakage.

Obviously, many variations and modifications of the present invention are possible in light of the above teachings. For example, while only two separable carriage assemblies have been disclosed as being supported upon, for example, the upstanding post or mast, more than two separable carriage assemblies can in fact be disposed upon the upstanding post or mast whereby during a wrapping or packaging film exchange operation, the upstanding post or mast would undergo an angular orientation of less than 180°. It is therefore to be understood that within the scope of the appended claims, the present invention may be practiced otherwise than as specifically described herein.

What is claimed as new and desired to be protected by Letters Patent of the United States of America, is:

1. Film exchange apparatus, for installing a fresh roll of wrapping film disposed upon a carriage assembly which is adapted to be separably mounted upon a film roll mounting and dispensing carriage assembly that is mounted upon a film wrapping machine, comprising:

first and second separable carriage assemblies respectively having spools disposed thereon for respectively removably mounting rolls of wrapping film thereon, and respectively having first rollers disposed thereon for cooperating with second rollers disposed upon the film roll mounting and dispensing carriage assembly in defining a film feed mechanism for feeding wrapping film from a roll of wrapping film toward a load to be wrapped within the wrapping film;

a support arm assembly for removably mounting and supporting said first and second separable carriage assemblies thereon such that either one of said first and second separable carriage assemblies can be removed from the film roll mounting and dispensing carriage assembly mounted upon the film wrapping machine and mounted upon said support arm assembly, and removed from said support arm assembly and mounted upon the film roll mounting and dispensing carriage assembly mounted upon the film wrapping machine; and a motorized drive for moving said support arm assembly with respect to the film roll mounting and dispensing carriage assembly mounted upon the film wrapping machine such that when a roll of wrapping film, disposed upon a first one of said first and second separable carriage assemblies which is disposed upon the film roll mounting and dispensing carriage assembly of the film wrapping machine, needs to be replaced, said first one of said first and second separable carriage assemblies, disposed upon the film roll mounting and dispensing carriage assembly mounted upon the film wrapping machine, can be removed from the film roll mounting and dispensing carriage assembly mounted upon the film wrapping machine and deposited upon said support arm assembly, while a second one of said first and second separable carriage assemblies, having a fresh roll of wrapping film disposed thereon and disposed upon said support arm assembly means, can be subsequently installed upon the film roll mounting and dispensing carriage assembly mounted upon the film wrapping machine.

2. The film exchange apparatus as set forth in claim 1, wherein said support arm assembly for removably mounting and supporting said first and second separable carriage assemblies thereon, comprises:

an upstanding mast member having a vertically oriented axis; and first and second sets of support arms disposed upon opposite sides of said upstanding mast member for respectively supporting said first and second separable carriage assemblies upon said opposite sides of said upstanding mast member.

3. The film exchange apparatus as set forth in claim 2, further comprising:

a support plate;

said upstanding mast member being rotatably mounted upon said support plate so as to be angularly rotatable around said vertically oriented axis.

4. The film exchange apparatus as set forth in claim 3, wherein said motorized drive for moving said support arm assembly with respect to the film roll mounting and dispensing carriage assembly mounted upon the film wrapping machine comprises:

a first motor drive for moving said support plate in a translational mode toward and away from the film roll mounting and dispensing carriage assembly mounted upon the film wrapping machine; and a second motor drive for rotating said upstanding mast member around said vertically oriented axis between first and second angular positions so as to selectively dispose a first one of said first and second sets of support arms toward the film roll mounting and dispensing carriage assembly mounted upon the film wrapping machine when said upstanding mast member is disposed at a first one of said first and second angular positions such that said first one of said first and second separable carriage assemblies, disposed upon the film roll mounting and dispensing carriage assembly of the film wrapping machine, can be removed from the film roll mounting and dispensing carriage assembly of the film wrapping machine and mounted upon said first one of said first and second sets of support arms, and to selectively dispose a second one of said first and second sets of support arms toward the film roll mounting and dispensing carriage assembly mounted upon the film wrapping machine when said upstanding mast member is disposed at a second one of said first and second angular positions such that said second one of said first and second separable carriage assemblies, disposed upon said second one of said first and second sets of support arms, can be removed from said second one of said first and second sets of support arms and mounted upon the film roll mounting and dispensing carriage assembly of the film wrapping machine.

5. The film exchange apparatus as set forth in claim 4, further comprising:

slots respectively disposed upon said first and second separable carriage assemblies for engaging and disengaging pins disposed upon the film roll mounting and dispensing carriage assembly of the film wrapping machine defining slotted connections with said pins disposed upon the film roll mounting and dispensing carriage assembly of the film wrapping machine so as to permit said first and second separable carriage assemblies to be mounted upon and removed from the film roll mounting and dispensing carriage assembly mounted upon the film wrapping machine.

6. The film exchange apparatus as set forth in claim 5, further comprising:

piston-cylinder assemblies mounted upon said upstanding mast member and operatively connected to said first and second sets of support arms disposed upon said opposite sides of said upstanding mast member for respectively moving said first and second sets of support arms with respect to said upstanding mast member in order to remove said first and second separable carriage assemblies from the film roll mounting and dispensing carriage assembly mounted upon the film wrapping machine, and to install said first and second separable carriage assemblies onto the film roll mounting and dispensing carriage assembly mounted upon the film wrapping machine, by said slotted connections.

7. The film exchange apparatus as set forth in claim 6, further comprising:

a programmable logic controller for controlling said first motor drive, said second motor drive, and said piston-cylinder assemblies.

8. Film exchange apparatus, for installing a fresh roll of wrapping film disposed upon a carriage assembly which is adapted to be separably mounted upon a film roll mounting and dispensing carriage assembly that is mounted upon a film wrapping machine, comprising:

a film roll mounting and dispensing carriage assembly, having first rollers disposed thereon, mounted upon a film wrapping machine;

first and second separable carriage assemblies respectively having spools disposed thereon for respectively removably mounting rolls of wrapping film thereon, and respectively having second rollers disposed thereon for cooperating with said first rollers disposed upon said film roll mounting and dispensing carriage assembly in defining a film feed mechanism for feeding wrapping film from a roll of wrapping film toward a load to be wrapped within the wrapping film;

a support arm assembly for removably mounting and supporting said first and second separable carriage assemblies thereon such that either one of said first and second separable carriage assemblies can be removed from said film roll mounting and dispensing carriage assembly mounted upon the film wrapping machine and mounted upon said support arm assembly, and removed from said support arm assembly and mounted upon said film roll mounting and dispensing carriage assembly mounted upon said film wrapping machine; and a motorized drive for moving said support arm assembly with respect to said film roll mounting and dispensing carriage assembly mounted upon said film wrapping machine such that when a roll of wrapping film, disposed upon a first one of said first and second separable carriage assemblies which is disposed upon said film roll mounting and dispensing carriage assembly of said film wrapping machine, needs to be replaced, said first one of said first and second separable carriage assemblies, disposed upon said film roll mounting and dispensing carriage assembly of the film wrapping machine, can be removed from said film roll mounting and dispensing carriage assembly mounted upon said film wrapping machine and deposited upon said support arm assembly while a second one of said first and second separable carriage assemblies, having a fresh roll of wrapping film disposed thereon and disposed upon said support arm assembly can be subsequently installed upon said film roll mounting and dispensing carriage assembly mounted upon said film wrapping machine.

9. The film exchange apparatus as set forth in claim 8, wherein said support arm assembly for removably mounting and supporting said first and second separable carriage assemblies thereon, comprises:

an upstanding mast member having a vertically oriented axis; and first and second sets of support arms disposed upon opposite sides of said upstanding mast member for respectively supporting said first and second separable carriage assemblies upon said opposite sides of said upstanding mast member.

10. The film exchange apparatus as set forth in claim 9, further comprising:

a support plate;

said upstanding mast member being rotatably mounted upon said support plate so as to be angularly rotatable around said vertically oriented axis.

11. The film exchange apparatus as set forth in claim 10, wherein said motorized drive for moving said support arm assembly with respect to said film roll mounting and dispensing carriage assembly mounted upon the film wrapping machine comprises:

a first motor drive for moving said support plate in a translational mode toward and away from said film roll mounting and dispensing carriage assembly mounted upon the film wrapping machine; and a second motor drive for rotating said upstanding mast member around said vertically oriented axis between first and second angular positions so as to selectively dispose a first one of said first and second sets of support arms toward said film roll mounting and dispensing carriage assembly mounted upon the film wrapping machine when said upstanding mast member is disposed at a first one of said first and second angular positions such that said first one of said first and second separable carriage assemblies, disposed upon the film roll mounting and dispensing carriage assembly of the film wrapping machine, can be removed from said film roll mounting and dispensing carriage assembly of the film wrapping machine and mounted upon said first one of said first and second sets of support arms, and to selectively dispose a second one of said first and second sets of support arms toward said film roll mounting and dispensing carriage assembly mounted upon the film wrapping machine when said upstanding mast member is disposed at a second one of said first and second angular positions such that said second one of said first and second separable carriage assemblies, disposed upon said second one of said first and second sets of support arms, can be removed from said second one of said first and second sets of support arms and mounted upon said film roll mounting and dispensing carriage assembly of the film wrapping machine.

12. The film exchange apparatus as set forth in claim 11, further comprising:

pins disposed upon said film roll mounting and dispensing carriage assembly of the film wrapping machine; and slots respectively disposed upon said first and second separable carriage assemblies for engaging and disengaging said pins disposed upon said film roll mounting and dispensing carriage assembly of the film wrapping machine for defining slotted type connections with said pins disposed upon said film roll mounting and dispensing carriage assembly of the film wrapping machine so as to permit said first and second separable carriage assemblies to be mounted upon and removed from said film roll mounting and dispensing carriage assembly mounted upon the film wrapping machine.

13. The film exchange apparatus as set forth in claim 12, further comprising:

piston-cylinder assemblies mounted upon said upstanding mast member and operatively connected to said first and second sets of support arms disposed upon said opposite sides of said upstanding mast member for respectively moving said first and second sets of support arms with respect to said upstanding mast member in order to remove said first and second separable carriage assemblies from said film roll mounting and dispensing carriage assembly mounted upon the film wrapping machine, and to install said first and second separable carriage assemblies onto said film roll mounting and dispensing carriage assembly mounted upon the film wrapping machine, by said slotted connections.

14. The film exchange apparatus as set forth in claim 13, further comprising:

a programmable logic controller for controlling said first motor drive, said second motor drive, and said piston-cylinder assemblies.

15. A method of performing a film exchange operation whereby a fresh roll of wrapping film can be installed onto a film roll mounting and dispensing carriage assembly mounted upon a film wrapping machine, comprising the steps of:

mounting a film roll mounting and dispensing carriage assembly, having first rollers disposed thereon, upon a film wrapping machine;

providing first and second separable carriage assemblies respectively having spools disposed thereon for respectively removably mounting rolls of wrapping film thereon, and respectively having second rollers disposed thereon for cooperating with said first rollers disposed upon said film roll mounting and dispensing carriage assembly in defining a film feed mechanism for feeding wrapping film from a roll of wrapping film toward a load to be wrapped within the wrapping film;

providing a support arm assembly for removably mounting and supporting said first and second separable carriage assemblies thereon such that either one of said first and second separable carriage assemblies can be removed from said film roll mounting and dispensing carriage assembly mounted upon the film wrapping machine and mounted upon said support arm assembly, and removed from said support arm assembly and mounted upon said film roll mounting and dispensing carriage assembly mounted upon the film wrapping machine;

removably mounting a first separable carriage assembly, having a fresh roll of wrapping film removably disposed thereon, upon said support arm assembly; and moving said support arm assembly with respect to said film roll mounting and dispensing carriage assembly mounted upon the film wrapping machine such that when a roll of wrapping film, disposed upon a second separable carriage assembly that is disposed upon said film roll mounting and dispensing carriage assembly of the film wrapping machine, needs to be replaced, said second separable carriage assembly, disposed upon said film roll mounting and dispensing carriage assembly of the film wrapping machine, can be removed from said film roll mounting and dispensing carriage assembly mounted upon the film wrapping machine while said first separable carriage assembly, having the fresh roll of wrapping film disposed thereon, can be subsequently installed upon said film roll mounting and dispensing carriage assembly mounted upon said film wrapping machine.

16. The method as set forth in claim 15, further comprising the step of:

providing first and second sets of support arms upon opposite sides of an upstanding mast member, having a vertically oriented axis, for respectively supporting said first and second separable carriage assemblies upon said opposite sides of said upstanding mast member.

17. The method as set forth in claim 16, further comprising the step of:

rotatably mounting said upstanding mast member upon a support plate so as to be angularly rotatable around said vertically oriented axis.

18. The method as set forth in claim 17, further comprising the steps of:

moving said support plate in a translational mode toward said film roll mounting and dispensing carriage assembly mounted upon the film wrapping machine such that said second set of support arms, mounted upon said upstanding mast member, can approach said film roll mounting and dispensing carriage assembly mounted upon said film wrapping machine so as to remove said second separable carriage assembly from said film roll mounting and dispensing carriage assembly mounted upon the film wrapping machine;

moving said support plate in a translational mode away from said film roll mounting and dispensing carriage assembly mounted upon the film wrapping machine, after said second set of support arms, mounted upon said upstanding mast member, have removed said second separable carriage assembly from said film roll mounting and dispensing carriage assembly mounted upon the film wrapping machine;

angularly rotating said upstanding mast member around said vertically oriented axis thereof such that said second separable carriage assembly, mounted upon said second set of support arms, is disposed away from said film roll mounting and dispensing carriage assembly mounted upon the film wrapping machine while said first separable carriage assembly, mounted upon said first set of support arms and having the fresh roll of wrapping film removably disposed thereon, is disposed toward said film roll mounting and dispensing carriage assembly mounted upon said film wrapping machine; and moving said support plate in a translational mode toward said film roll mounting and dispensing carriage assembly mounted upon the film wrapping machine such that said first set of support arms, having said first separable carriage assembly mounted thereon, can approach said film roll mounting and dispensing carriage assembly mounted upon the film wrapping machine so as to install said first separable carriage assembly, having the fresh roll of wrapping film removably disposed thereon, onto said film roll mounting and dispensing carriage assembly mounted upon said film wrapping machine.

19. The method as set forth in claim 16, further comprising the step of:

respectively providing slots upon said first and second separable carriage assemblies for engaging and disengaging pins disposed upon said film roll mounting and dispensing carriage assembly of the film wrapping machine so as to define slotted connections with said pins disposed upon said film roll mounting and dispensing carriage assembly of the film wrapping machine so as to permit said first and second separable carriage assemblies to be mounted upon and removed from said film roll mounting and dispensing carriage assembly mounted upon the film wrapping machine.

20. The method as set forth in claim 19, further comprising the steps of:

mounting piston-cylinder assemblies upon said upstanding mast member; and operatively connecting said piston-cylinder assemblies to said first and second sets of support arms disposed upon said opposite sides of said upstanding mast member for respectively moving said first and second sets of support arms with respect to said upstanding mast member in order to remove said first and second separable carriage assemblies from said film roll mounting and dispensing carriage assembly mounted upon the film wrapping machine, and to install said first and second separable carriage assemblies onto said film roll mounting and dispensing carriage assembly mounted upon the film wrapping machine, by said slotted connections.

* * * * *